US009362633B2

(12) United States Patent
Hannah

(10) Patent No.: US 9,362,633 B2
(45) Date of Patent: Jun. 7, 2016

(54) HYBRIDIZED COAXIAL CABLE CONNECTOR

(71) Applicant: PDS Electronics, Inc., Tallmadge, OH (US)

(72) Inventor: Steven K. Hannah, Hudson, OH (US)

(73) Assignee: PDS Electronics, Inc., Tallmadge, OH (US)

( * ) Notice: Subject to any disclaimer, the term of this patent is extended or adjusted under 35 U.S.C. 154(b) by 0 days.

(21) Appl. No.: 14/536,005

(22) Filed: Nov. 7, 2014

(65) Prior Publication Data

US 2015/0126063 A1 May 7, 2015

Related U.S. Application Data

(60) Provisional application No. 61/901,165, filed on Nov. 7, 2013, provisional application No. 61/933,469, filed on Jan. 30, 2014.

(51) Int. Cl.

| | |
|---|---|
| ***H01R 9/05*** | (2006.01) |
| ***H01R 4/02*** | (2006.01) |
| ***H01R 24/40*** | (2011.01) |

(52) U.S. Cl.

CPC ..... *H01R 9/0518* (2013.01); *H01R 4/023* (2013.01); *H01R 24/40* (2013.01)

(58) Field of Classification Search

CPC ..... H01R 2103/00; H01R 9/05; H01R 9/0518

USPC ..... 439/585, 578, 584

See application file for complete search history.

(56) References Cited

U.S. PATENT DOCUMENTS

| | | | | |
|---|---|---|---|---|
| 3,701,086 | A | 10/1972 | Somerset | |
| 4,135,776 | A * | 1/1979 | Ailawadhi | H01R 9/0521 439/583 |
| 4,453,796 | A * | 6/1984 | Monroe | H01R 9/0518 439/581 |
| 4,553,806 | A * | 11/1985 | Forney, Jr. | H01R 24/562 439/277 |
| 4,813,887 | A * | 3/1989 | Capp | H01R 24/562 439/580 |
| 5,147,221 | A * | 9/1992 | Cull | H01R 24/40 439/585 |
| 7,416,415 | B2 * | 8/2008 | Hart | H01R 24/52 439/579 |
| 2004/0082218 | A1 | 4/2004 | Stirling | |
| 2011/0138623 | A1 | 6/2011 | Merical | |

OTHER PUBLICATIONS

"Cable Assembly Instructions", RF Connectors, www.rfindustries.com, pp. 1-4.

"Type-N connector assembly instruction", vaqtec: vacuum technology & components, Oct. 2, 2011, pp. 1-2.

* cited by examiner

*Primary Examiner* — Amy Cohen Johnson
*Assistant Examiner* — Oscar C Jimenez
(74) *Attorney, Agent, or Firm* — Ulmer & Berne LLP

(57) ABSTRACT

A hybridized connector apparatus is provided for solder connection with a central conductor of an associated coaxial cable and for crimp connection with a conductive braid and foil of the coaxial cable, and includes a hollow, generally cylindrical contact pin member or tip portion operably received into an interior of a generally ring-shaped dielectric spacer disk. The dielectric is received into a connector body, which is received into a shell. An end of the contact pin member defines an interface portion having a substantially constant outer diameter D extending outwardly from the spacer disk beyond an extent of the body member in an insertion direction I. The interface portion defines a semicircular edge portion and may also include a linear edge portion disposed in a plane substantially oblique to the longitudinal axis, and a curvilinear edge portion.

11 Claims, 19 Drawing Sheets

HYBRIDIZED COAXIAL CABLE CONNECTOR

CROSS REFERENCE TO RELATED APPLICATIONS

This application claims benefit to U.S. Provisional Patent Application Ser. No. 61/933,469 filed on Jan. 30, 2014, the contents of which are incorporated herein by reference; and to U.S. Provisional Patent Application Ser. No. 61/901,165 filed on Nov. 7, 2013, the contents of which are incorporated herein by reference.

TECHNICAL FIELD

The subject application is directed generally to the field of electrical connectors. In particular, the application is directed to cable connectors of the type used with associated coaxial cable and finds application in connection with radio frequency transmission of signals on the associated coaxial cable through the connector. Embodiments of the subject application will be described with reference to hybridized male electrical connectors suitable for direct replacement of standard PL-259 connectors to be used with female SO-239 sockets thereby making the connection of the associated coaxial cables with female SO-239 sockets by means of the subject hybridized connector.

BACKGROUND

Coaxial cable, sometimes referred to as "coax," is comprised of a generally tubular outer conductor disposed around an inner conductor separated by an insulator. Coaxial cable is advantageous for use in connection with signal transmission, such as modulated communication signals. Cable dimensions can be controlled to include precise spacing between the conductors so as to function as efficient transmission lines.

Coaxial cables are widely used in conjunction with transmission of communication signals, including radio frequency ("RF") transmission, audio or video transmission, or modulated data signals, such as transmission of digital data.

As with any transmission or conductive table, cable lengths are of course finite. Longer cabling runs may require connection or splicing among multiple cable lengths. Additionally, insofar as cables ultimately serve to provide a signal path between devices, appropriate electro-mechanical connections must be made.

Specialized connectors assist in securing a signal connection between coaxial cables, or between a coaxial cable and a device. Such devices may include a transmitter or a receiver, or a bi-directional path between two or more transceivers. Specialized coaxial connectors are typically used to complete any such connection. Specialized connectors are available for many types of coaxial cables. Designs exist to allow quick connection or disconnection. Connectors are also designed to maximize transmission efficiency so as to minimize signal loss, reflection or distortion.

One type of coaxial connector in widespread use in connection with UHF transmissions is a PL-259 connector, wherein "PL" is definitive of a (male) plug. A corresponding socket designation is the (female) SO-239. This conductor is frequently used in connection with larger-diameter coaxial connectors, and with frequencies in the radio band inclusive of frequencies up to about 400 MHz. These connectors are representative of many types of RF connectors in common use. In addition to use with radio transmissions, such connectors find common use in other applications.

Coaxial connectors, such as those noted above, typically have an internally threaded body which must be attached to a braided shield of the co-axial cable having an outside casing, which casing is usually made of a flexible, insulator material, such as rubber, plastic or the like. To effect the attachment, a portion of the cable with the casing removed is inserted into a body of the connector and is manipulated so that an outer ferrule may be crimped over a portion of the cable having casing remaining to hold the shield against an outer surface of the body of the connector. The center conductor of the coaxial cable is generally cut to extend beyond the remainder of a cable end, and extends through a hollow alignment pin of the plug so that it may be inserted into a central, hollow, cylindrical portion of the female connector. An efficient and solid signal path is formed by either filling the space between the alignment pin and the center conductor of the coaxial cable with a solder material or by mechanically crimping the alignment pin of the plug connector onto the center conductor of the coaxial cable to effect the connection therebetween.

Sometimes the placement of the solder on the connector adjacent the center conductor at an end of the alignment pin is mismanaged or malformed and, as a result, the internal components of the associated socket is damaged as the connector and socket are coupled. More particularly, one or more inwardly biased members within the socket body configured to surroundingly engage the center conductor portion of the connector often become irreversibly dislodged into a retracted radially outward position through use of the socket with a connector having excess solder material in the area of the central conductor. In addition, the inherent bias of the one or more members within the socket body is often lost through use of the connector having the excess solder material in the area of the central conductor. In both examples, the integrity of the electro-mechanical connection of the socket body with a new connector without the excess solder material in the area of the central conductor after being damaged such as by connectors having excess solder material in the area of the central conductor, for example, is often compromised.

It is, therefore, desirable to provide a hybridized male electrical connector having both a crimpable portion for connection with the braided shield of a coaxial cable and an improved solder connection portion for the center conductor of the coaxial cable to be used with new, damaged, or worn female sockets thereby ensuring good electrical and mechanical connection of associated coaxial cable with both new and worn female sockets by means of the subject hybridized connector. In particular, it is desirable to provide a hybridized male electrical connector having both a crimpable portion for connection with the braided shield of a coaxial cable and an improved solder connection portion for the center conductor of the coaxial cable suitable for direct replacement of standard PL-259 connectors to be used with new, damaged, or worn female SO-239 sockets thereby ensuring good electrical and mechanical connection between the associated female SO-239 sockets and the subject hybridized connector.

OVERVIEW OF EXAMPLE EMBODIMENTS

The following presents a simplified overview of the example embodiments in order to provide a basic understanding of some aspects of the example embodiments. This overview is not an extensive overview of the example embodiments. It is intended to neither identify key or critical elements of the example embodiments nor delineate the scope of the appended claims. Its sole purpose is to present some concepts of the example embodiments in a simplified form as a prelude to the more detailed description that is presented later.

In accordance with an example embodiment, a hybridized cable connector is provided for use with an associated coaxial cable having a central conductor, an insulating material surrounding the central conductor, a conductive braid surrounding the insulating material, and an outer jacket surrounding the conductive braid. The cable connector apparatus is a hybridized cable connector because it is configured for solder connection with a central conductor of an associated coaxial cable and for a crimp connection with a conductive braid or with the conductive braid and a foil member surrounding insulating material of the associated coaxial cable. The hybridized cable connector comprises, in general, a substantially cylindrical body member, a spacer disk, and a contact pin member having a substantially constant outer diameter extending outwardly from the spacer disk along a central longitudinal axis of the body member beyond an extent of the body member in an insertion direction directed from a first end of the body member to a second end of the body member opposite to the first end. In one example embodiment, the connector further comprises an outer shell member and a ferrule. Overall, the outer shell member is configured to assist in attaching and holding the connector to an associated female socket such as, for example, to an associated SO-239 connector. The ferrule is configured to be crimped onto the associated coaxial cable for attaching and holding the connector relative to the cable thereby effecting a good electromechanical connection between the conductive braid of the cable with the ferrule and connector body.

As noted, the example embodiments provide, in general, hybridized male electrical connectors to be used with new, damaged or worn female sockets thereby refurbishing the electrical and mechanical connection of associated coaxial cable with the worn female sockets by means of the subject hybridized connectors. In addition and in particular, the example embodiments provide hybridized male electrical connectors suitable for direct replacement of standard PL-259 connectors to be used with new, damaged or worn female SO-239 sockets thereby ensuring good electrical and mechanical connection between the associated female SO-239 sockets and the coaxial cable carried in the subject hybridized connector.

Still other advantages, aspects and features of the present methods and apparatus will become readily apparent to those skilled in the art from the following description wherein there is shown and described example embodiments, simply by way of illustration of one of the best modes best suited for to carry out the example embodiments. As it will be realized, the embodiments are capable of other different embodiments and its several details are capable of modifications in various obvious aspects all without departing from the scope of this disclosure. Accordingly, the drawings and descriptions will be regarded as illustrative in nature and not as restrictive.

BRIEF DESCRIPTION OF THE DRAWINGS

The embodiments may take physical form in certain parts and steps and arrangements of parts and steps, the example embodiments of which will be described in detail in the specification and illustrated in the accompanying drawings hereof and wherein.

Figure 1:
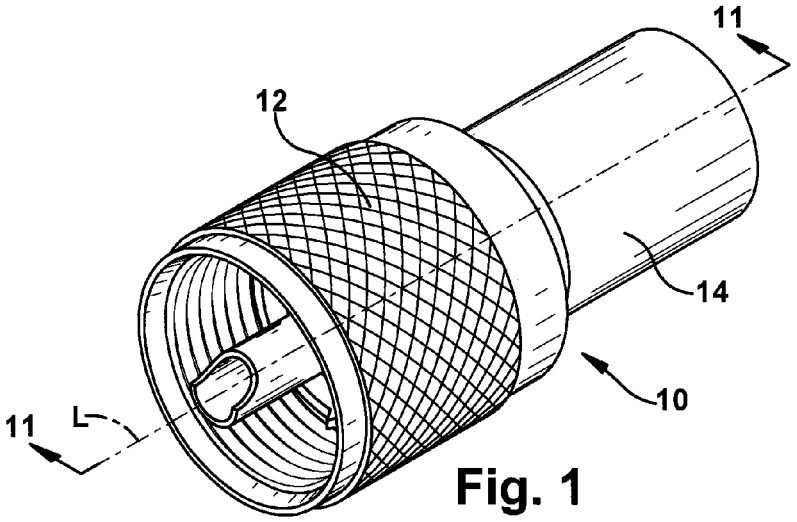
FIG. 1 is a perspective view of a connector in accordance with a first embodiment showing an outer shell and ferrule thereof attached with a subassembly of the connector.
Figure 13:
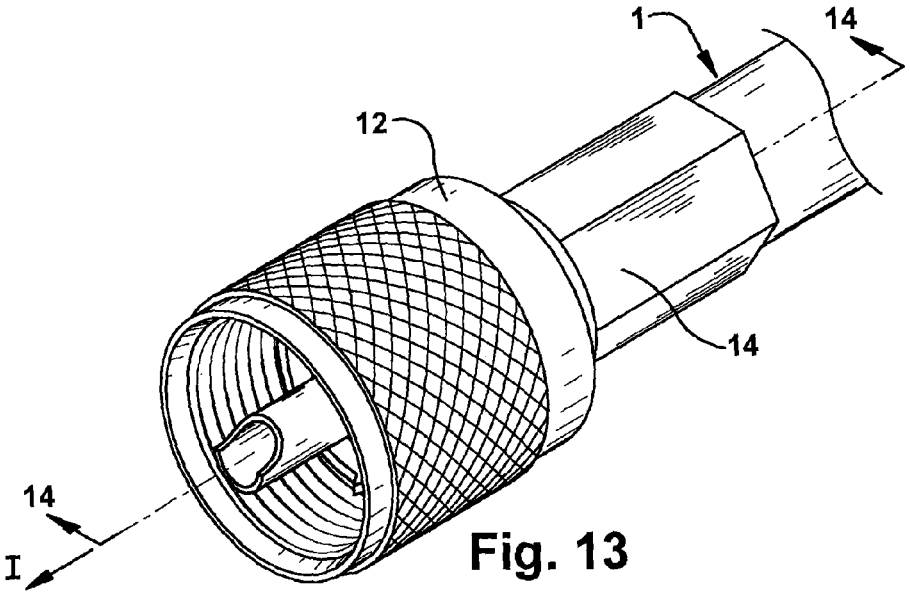
FIG. 13 is a perspective view of the connector of FIG. 1 showing the ferrule after being crimped onto an associated coaxial cable having a central conductor, an insulating material surrounding the central conductor, a conductive braid surrounding the insulating material, and an outer jacket surrounding the conductive braid.

FIG. **14*a* is an inverted cross-sectional view of the connector of FIG. 1 taken along line 14-14 in FIG. 13** illustrating the use of the connector with the associated coaxial cable wherein all of the outer jacket is removed from around the conductive braid shield in the area N adjacent the ferrule.

Figure 15:
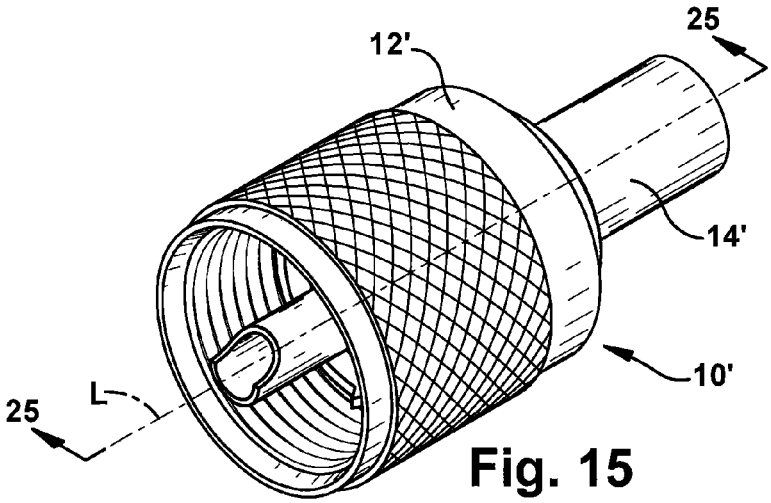

FIG. 15 is a perspective view of a connector in accordance with a second embodiment showing an outer shell and ferrule thereof attached with a subassembly of the connector.

Figure 16:
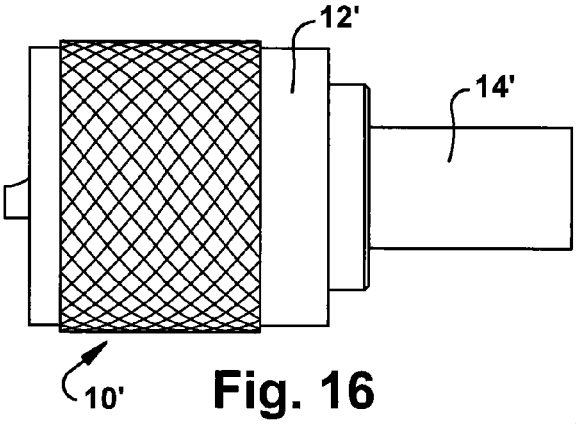

FIG. 16 is a side view of the connector of FIG. 15.

Figure 17:
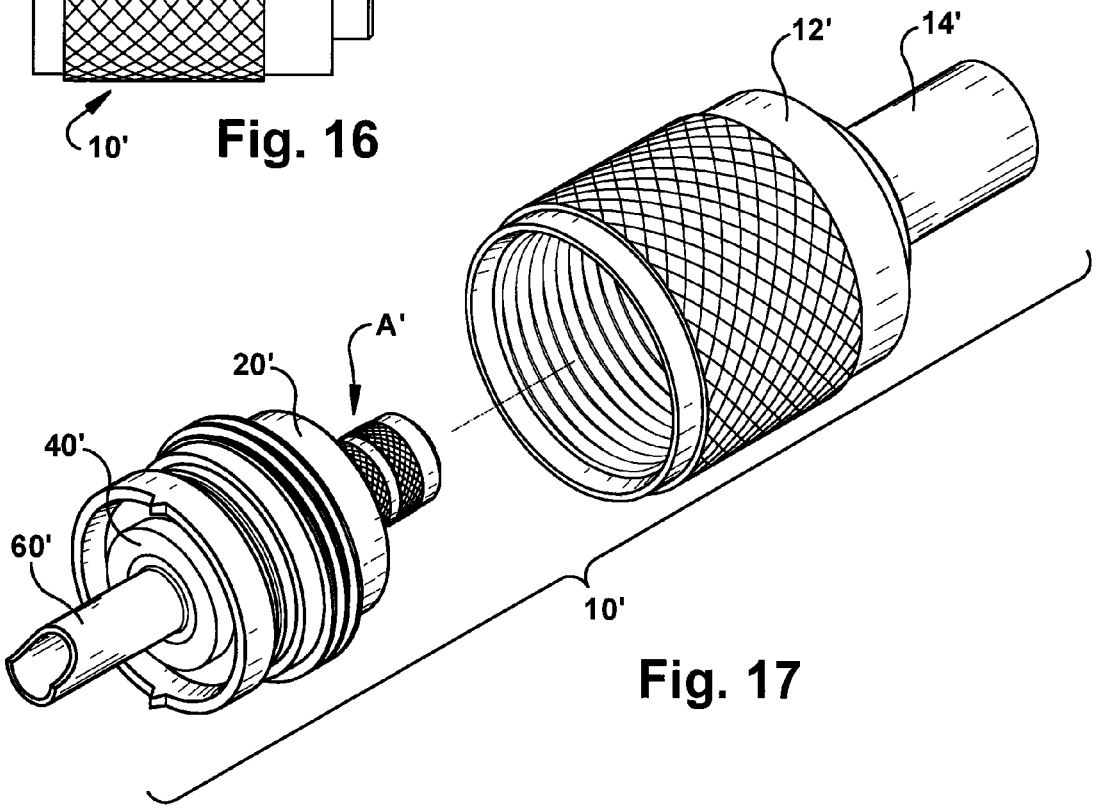

FIG. 17 is a perspective partially exploded view of the connector of FIG. 15 showing a subassembly of the connector separated from the outer shell and ferrule along a longitudinal axis of the connector.

Figure 18:
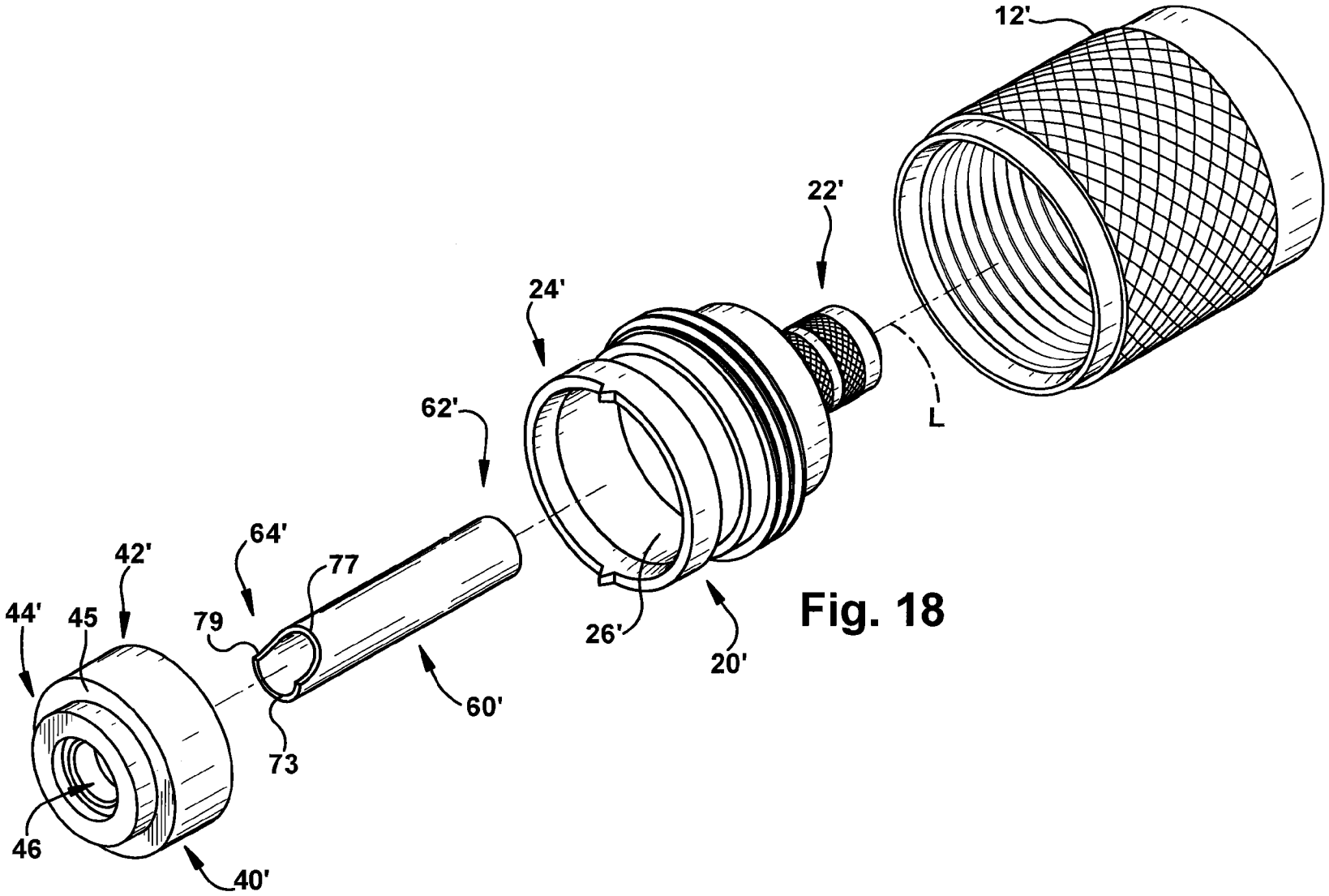

FIG. 18 is a perspective exploded view of the connector of FIG. 15 with the ferrule removed and showing components of the subassembly and the outer shell spaced apart along the longitudinal axis of the connector.

Figure 19:
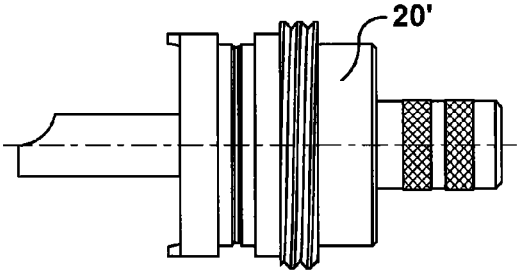

FIG. 19 is a front side view of the subassembly of the connector of FIG. 15.

Figure 20:
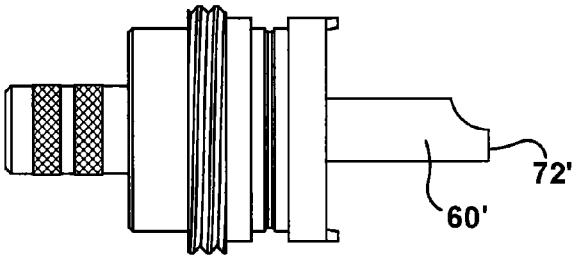

FIG. 20 is a rear side view of the subassembly of the connector of FIG. 15.

Figure 21:
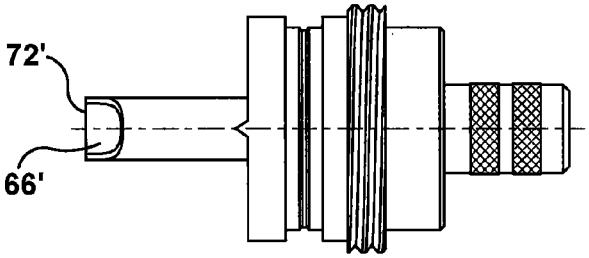

FIG. 21 is a top view of the subassembly of the connector of FIG. 15.

Figure 22:
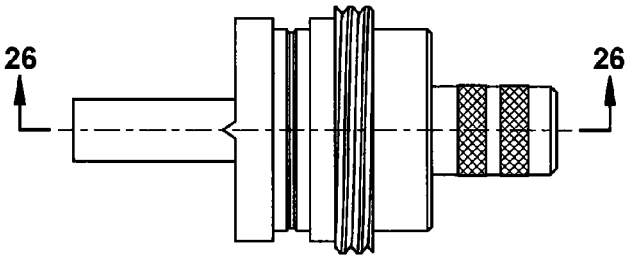

FIG. 22 is a bottom view of the subassembly of the connector of FIG. 15.

Figure 23:
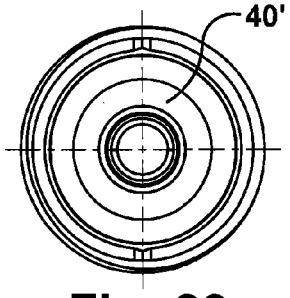

FIG. 23 is a longitudinal front end view of the subassembly of the connector of FIG. 15.

Figure 24:
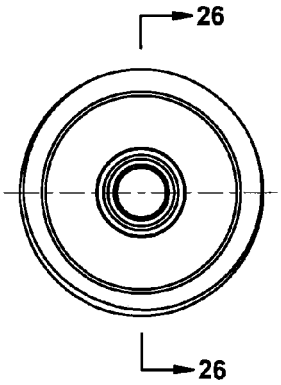

FIG. 24 is a longitudinal rear end view of the subassembly of the connector of FIG. 15.

Figure 25:
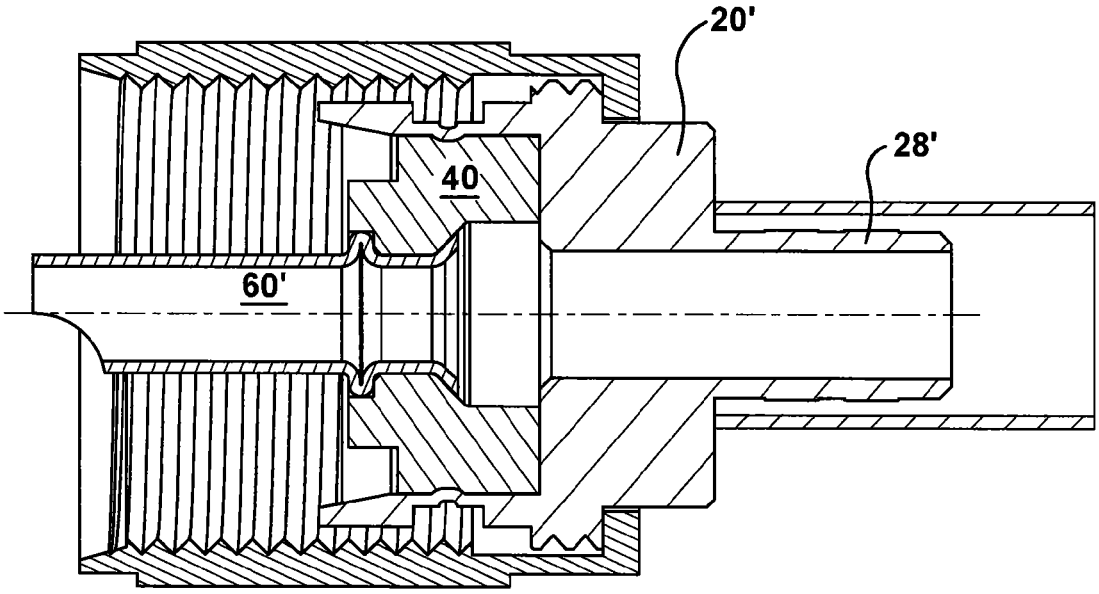

FIG. 25 is an inverted cross-sectional view of the connector of FIG. 15 taken along line 25-25 in FIG. 15.

Figure 26:
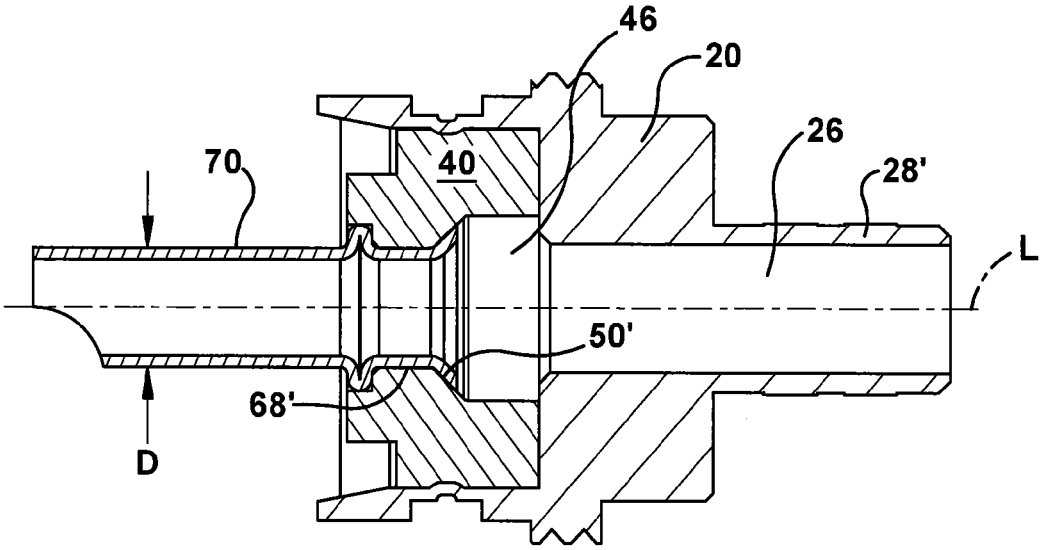

FIG. 26 is a cross-sectional view of the subassembly of the connector of FIG. 15 taken along line 26-26 in FIG. 22.

Figure 27:
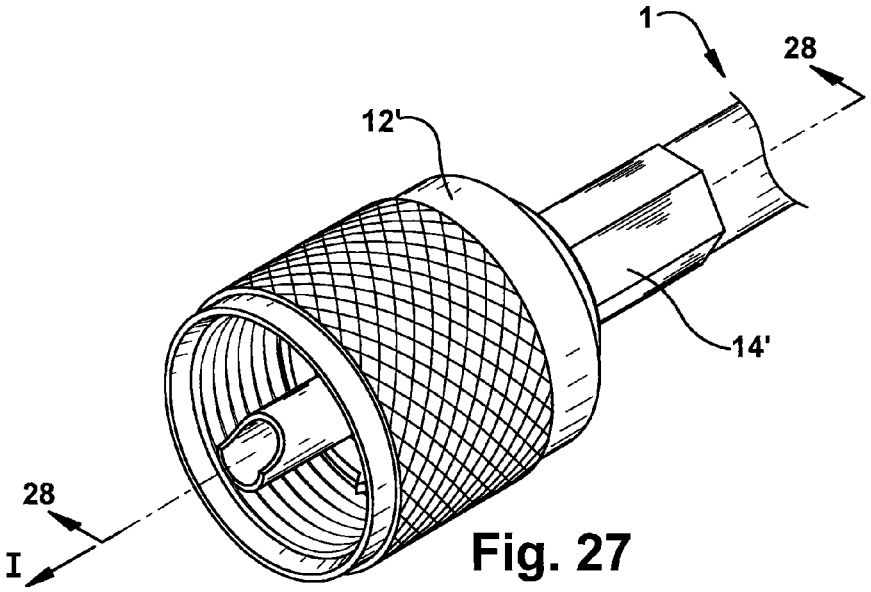

FIG. 27 is a perspective view of the connector of FIG. 15 showing the ferrule after being crimped onto an associated coaxial cable having a central conductor, an insulating material surrounding the central conductor, a conductive braid surrounding the insulating material, and an outer jacket surrounding the conductive braid.

Figure 28:
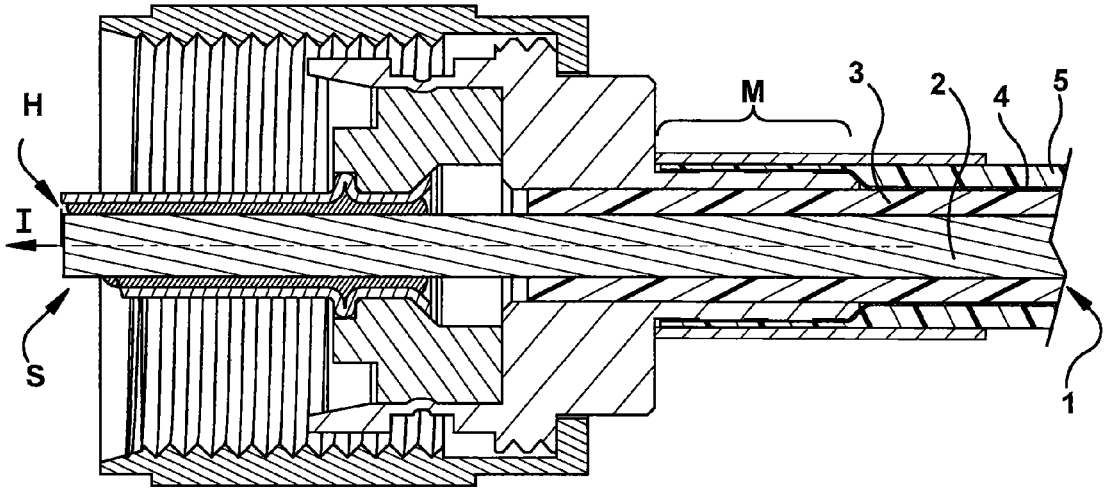

FIG. 28 is an inverted cross-sectional view of the connector of FIG. 15 taken along line 28-28 in FIG. 27 illustrating the use of the connector with the associated coaxial cable wherein a portion of the outer jacket is removed from around the conductive braid shield in an area M adjacent the ferrule.

Figure 28A:
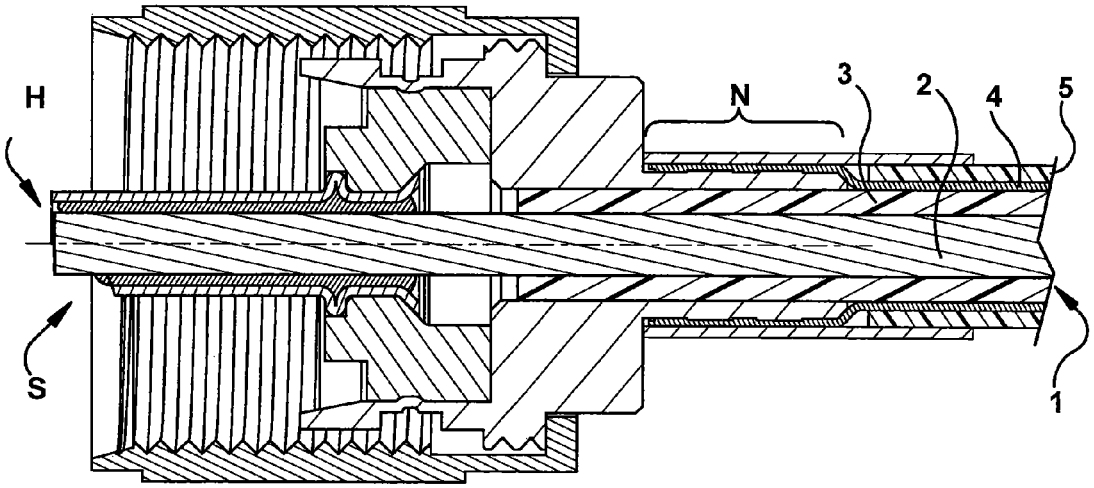

FIG. 28*a* is an inverted cross-sectional view of the connector of FIG. 15 taken along line 28-28 in FIG. 27 illustrating the use of the connector with the associated coaxial cable wherein all of the outer jacket is removed from around the conductive braid shield in the area N adjacent the ferrule.

Figure 29:
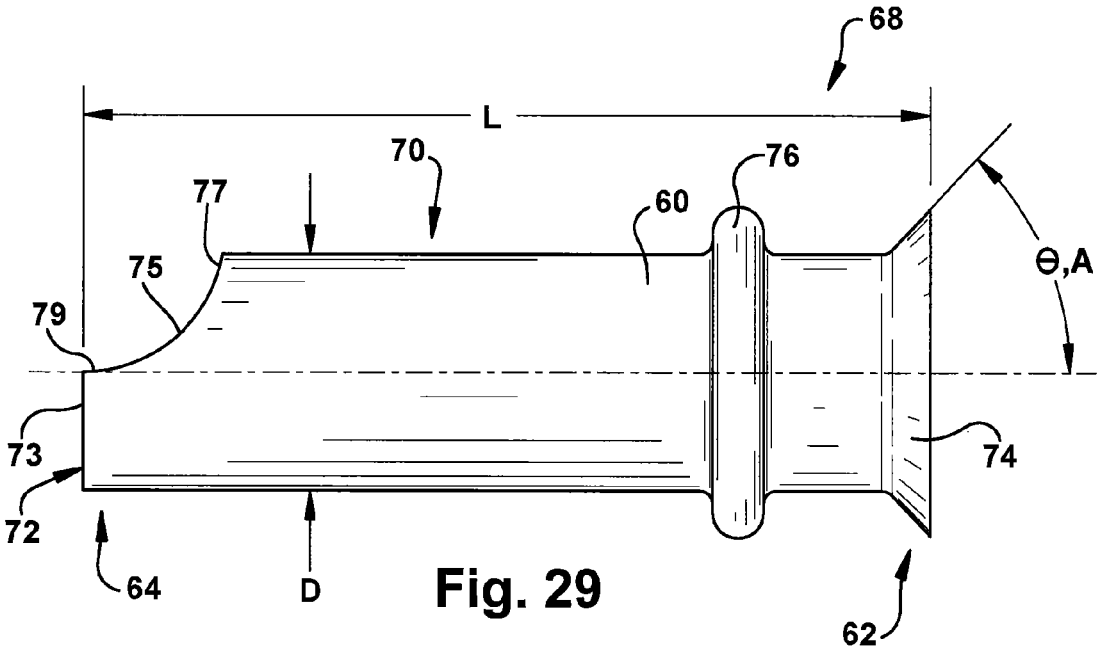

FIG. 29 is a side perspective view of a first embodiment of a contact pin member used in the first and second embodiments of the connector shown in FIGS. 1-14 and FIGS. 15-28, respectively.

Figure 30:
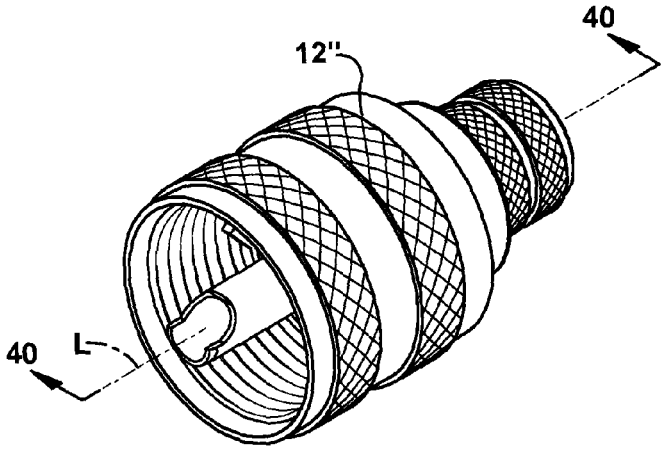

FIG. 30 is a perspective view of a connector in accordance with a third embodiment showing an outer shell and ferrule thereof attached with a subassembly of the connector.

Figure 31:
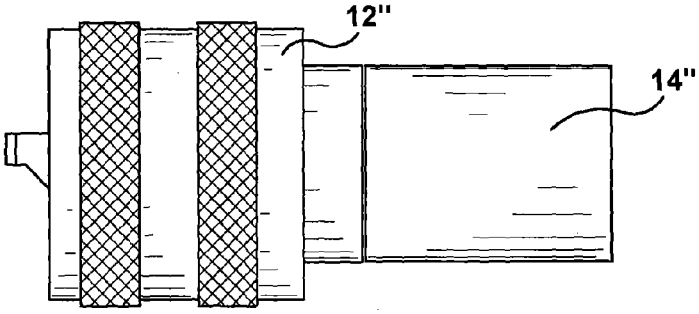

FIG. 31 is a side view of the connector of FIG. 30.

Figure 32:
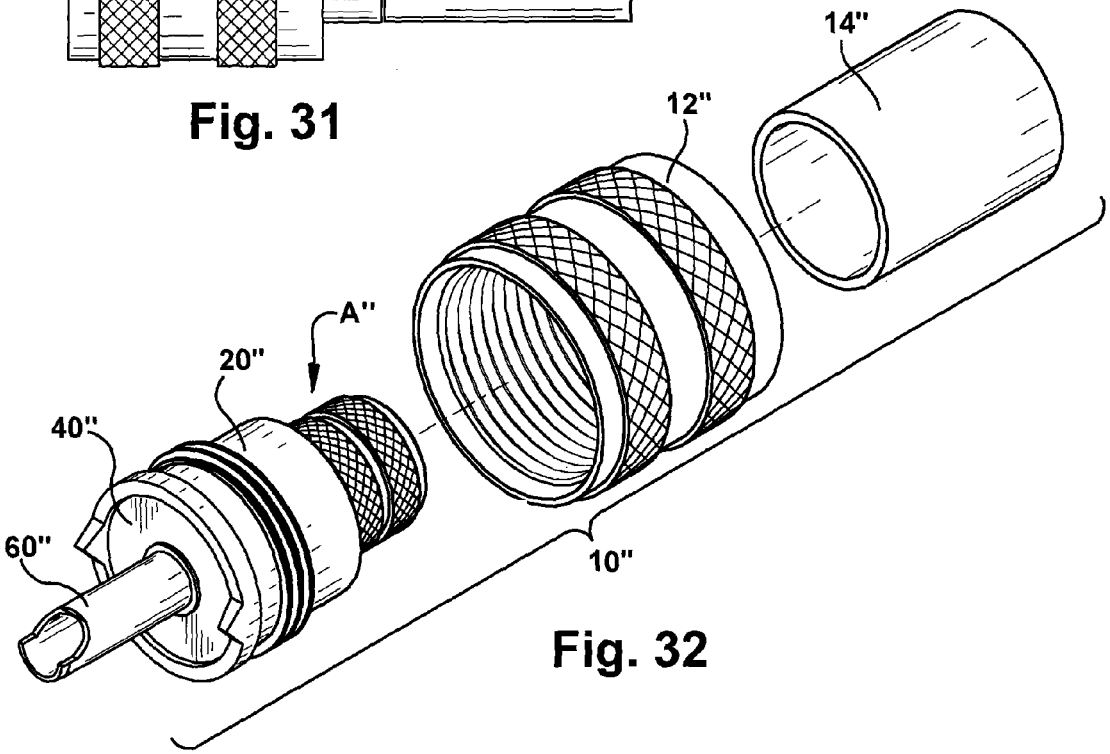

FIG. 32 is a perspective partially exploded view of the connector of FIG. 30 showing a subassembly of the connector separated from the outer shell and ferrule along a longitudinal axis of the connector.

Figure 33:
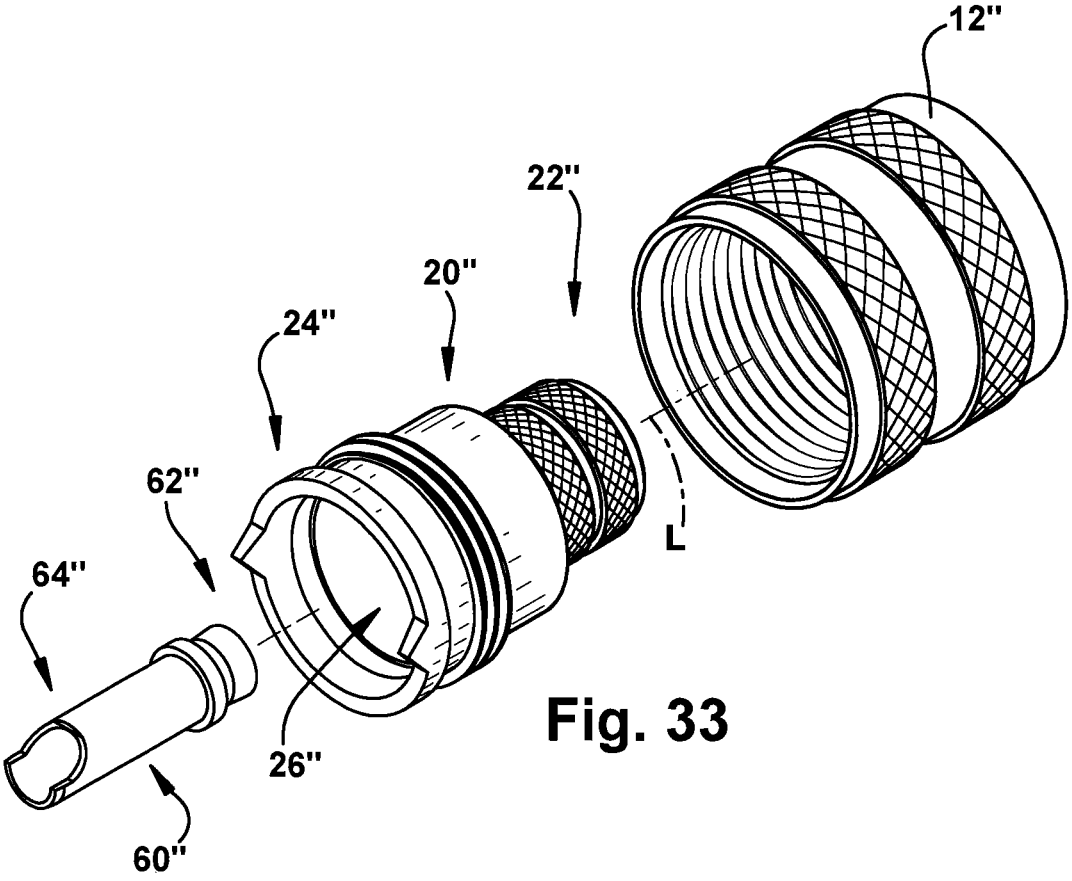

FIG. 33 is a perspective exploded view of the connector of FIG. 30 with the ferrule removed and showing components of the subassembly and the outer shell spaced apart along the longitudinal axis of the connector.

Figure 34:
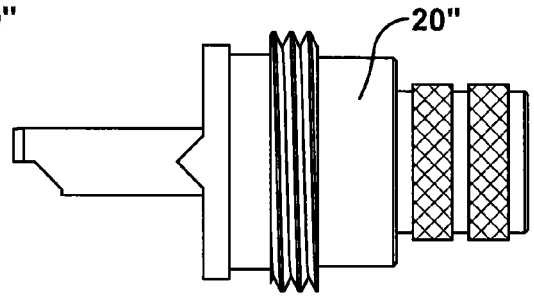

FIG. 34 is a front side view of the subassembly of the connector of FIG. 30.

Figure 35:
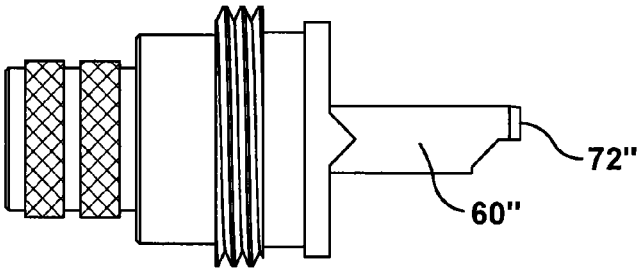

FIG. 35 is a rear side view of the subassembly of the connector of FIG. 30.

Figure 36:
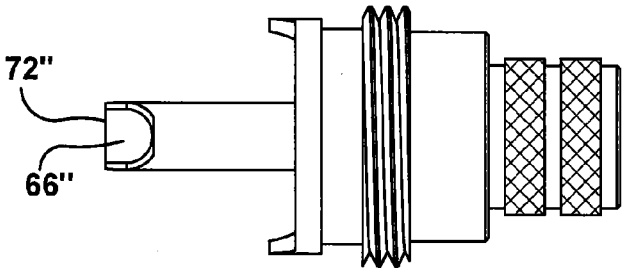

FIG. 36 is a top view of the subassembly of the connector of FIG. 30.

Figure 37:
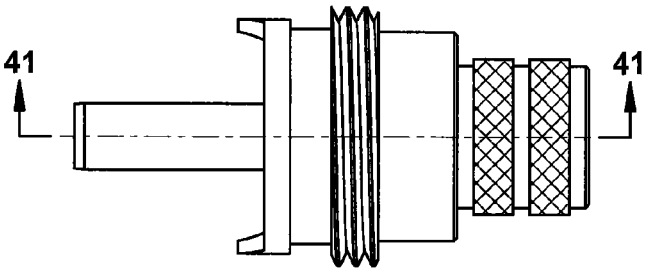

FIG. 37 is a bottom view of the subassembly of the connector of FIG. 30.

Figure 38:
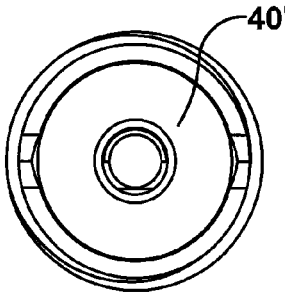

FIG. 38 is a longitudinal front end view of the subassembly of the connector of FIG. 30.

Figure 39:
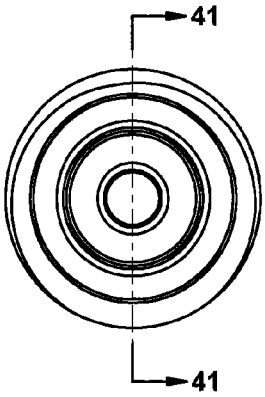

FIG. 39 is a longitudinal rear end view of the subassembly of the connector of FIG. 30.

Figure 40:
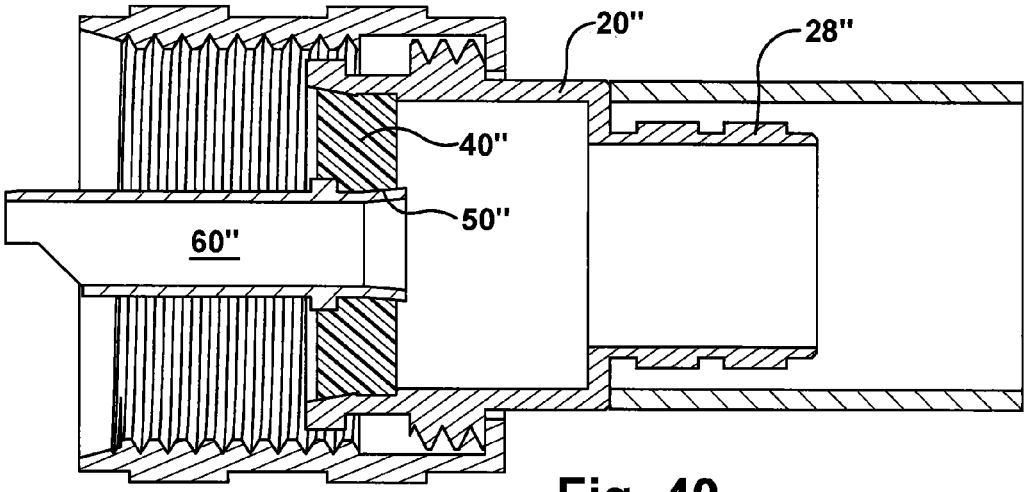

FIG. 40 is an inverted cross-sectional view of the connector of FIG. 30 taken along line 40-40 in FIG. 30.

Figure 41:
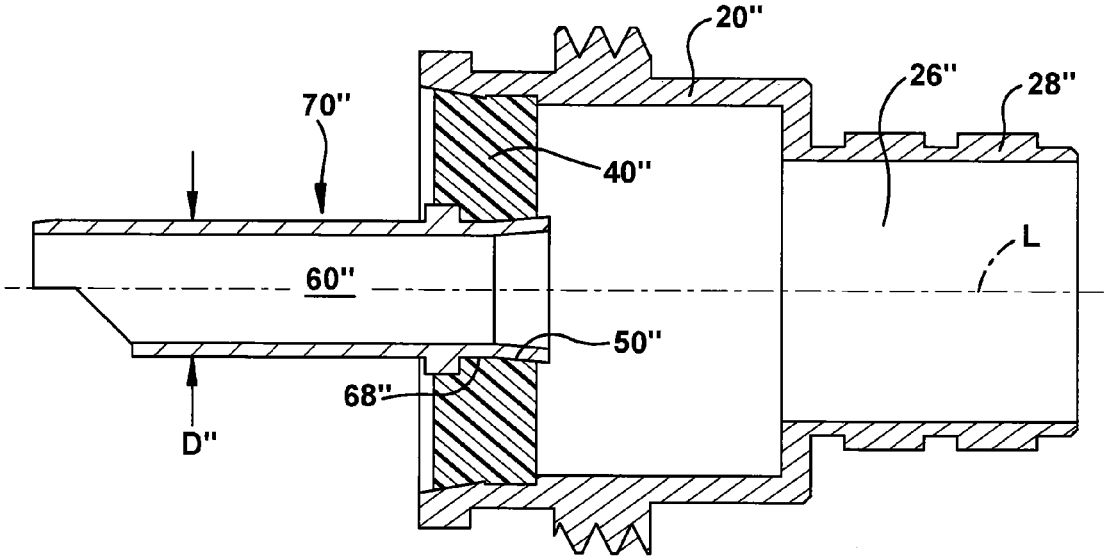

FIG. 41 is a cross-sectional view of the subassembly of the connector of FIG. 30 taken along line 41-41 in FIG. 37.

Figure 42:
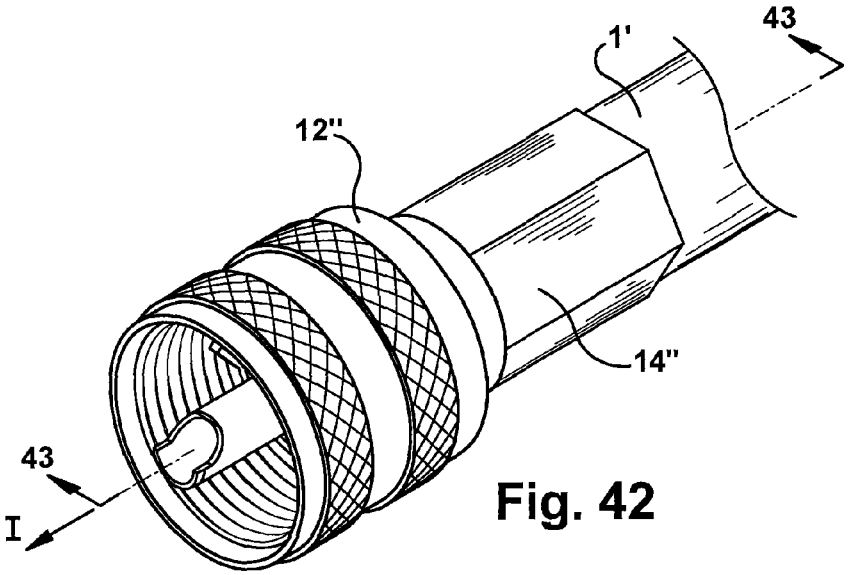

FIG. 42 is a perspective view of the connector of FIG. 30 showing the ferrule after being crimped onto an associated coaxial cable.

Figure 43:
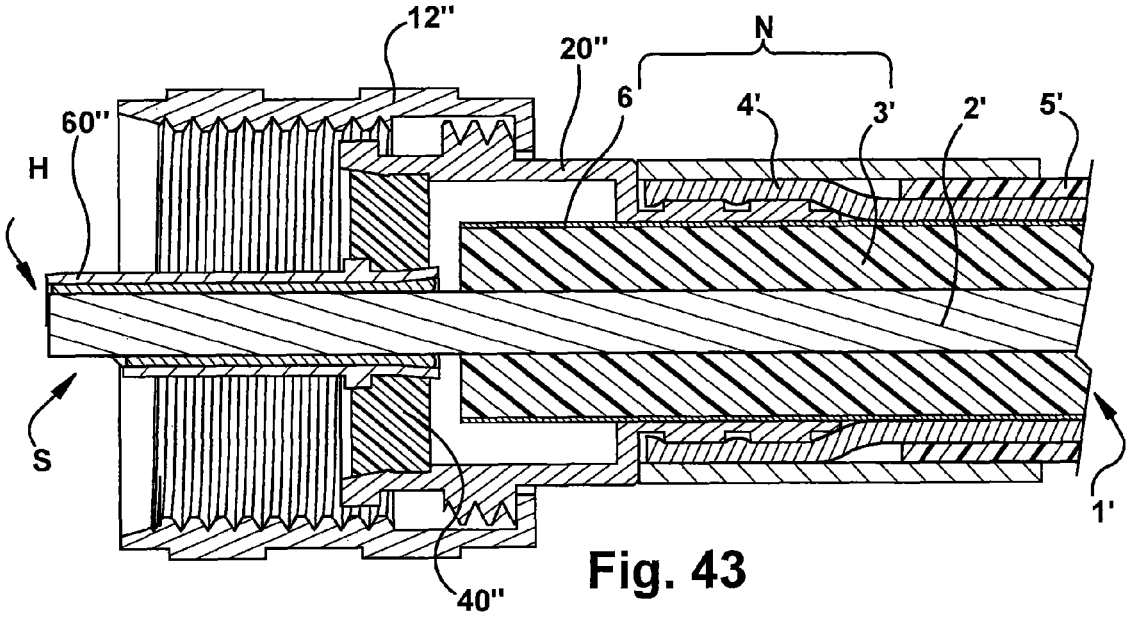

FIG. 43 is an inverted cross-sectional view of the connector of FIG. 30 taken along line 43-43 in FIG. 42.

Figure 44:
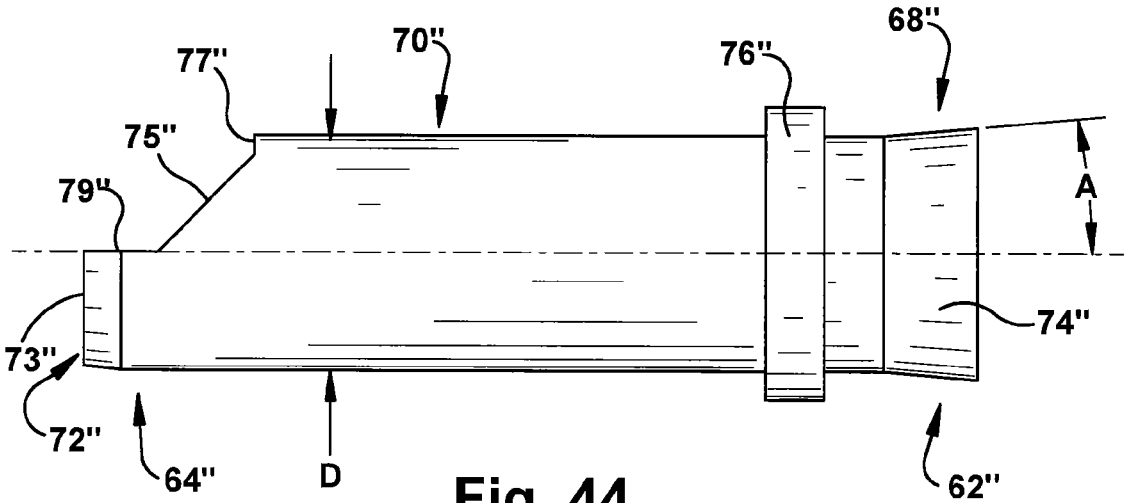

FIG. 44 is a side perspective view of a second embodiment of a contact pin member used in the third embodiment of the connector shown in FIGS. 30-43.

DETAILED DESCRIPTION OF EXAMPLE EMBODIMENTS

This description provides examples not intended to limit the scope of the appended claims. The figures generally indicate the features of the examples, where it is understood and appreciated that like reference numerals are used to refer to like elements. Reference in the specification to "one embodiment" or "an embodiment" or "an example embodiment" means that a particular feature, structure, or characteristic described is included in at least one embodiment described herein and does not imply that the feature, structure, or characteristic is present in all embodiments described herein.

Coaxial connectors are available for many applications. Required properties of a particular connector type correspond to properties of cables or applications with which they are to be associated. Such properties may include cable diameter, conductor diameter, relative conductor placement, physical characteristics of the cable, or sub-portions thereof. Connector properties may also be dictated by insulative, conductive or RF propagation or reflection characteristics, such as may be associated with particular amplitudes, frequencies, phases, voltage ranges, current ranges or impedance properties.

Given the wide range of characteristics, many types of coaxial connectors are available. By way of example, connector types include size types, such as miniature, sub-miniature and micro connectors.

A supplier must design, manufacture and stock connectors or connector sub-assemblies for many applications. Manufacturing of each connector type will typically require design and fabrication of tooling for each connector type. Such tooling, manufacturing changeover, inventory and transportation of various connectors adds significant cost, complexity and expense to manufacturers, sellers and consumers of connector products.

The subject application includes embodiments of a coaxial cable connector that are adaptable for use in connection with cables having different characteristics or different application requirements. Sub-portions of a connector are suitably substituted with portions appropriate for various applications. Thus, components are readily usable and changeable for particular applications, allowing for lower manufacturing, stocking and overall cost. In the embodiments illustrated and describe herein, various dimensions are understood to contemplated, which dimensions and relative dimensions are application specific as will be appreciated by one of ordinary skill in the art.

With reference now to the drawing Figures wherein the showings are for purposes of illustrating the example embodiments only and not for purposes of limiting same, FIGS. 1-14 and 29 show a hybridized cable connector 10 in accordance with a first example embodiment. As best shown in the cross-sectional view of FIG. 14, the connector is configured for use with an associated coaxial cable 1 having a central conductor 2, an insulating material 3 surrounding the central conductor 2, a conductive braid 4 surrounding the insulating material 3, and an outer jacket 5 surrounding the conductive braid 4. However, the connectors of the example embodiments are also configured for use with associated coaxial cables 1' such as the example shown in FIG. 43 having a central conductor 2', an insulating material 3' surrounding the central conductor 2', a foil layer 6 surrounding the insulating material 3', a conductive braid 4' surrounding the foil layer 6, and an outer jacket 5' surrounding the conductive braid 4'. The connectors of the embodiments herein are hybridized connectors because they are configured to make a solder connection between the central conductor 2, 2' of the coaxial cable 1, 1' and a contact pin member of the connector, and to make a mechanical crimp connection between the connector body and the i) conductive braid 4 or ii) the conductive braid and foil 4', 6 of the coaxial cable 1, 1' respectively.

In any case, the connector 10 comprises, in general, a substantially cylindrical body member 20, a spacer disk 40, and a contact pin member 60, forming a subassembly A of the connector 10. In the illustrate example, the connector 10 further comprises an outer shell member 12 and a ferrule 14. Overall, the outer shell member 12 is configured to assist in attaching and holding the connector 10 to an associated female socket connector (not shown) such as, for example, to an associated SO-239 connector. The ferrule 14 is configured to be crimped onto the associated coaxial cable 1 for attaching and holding the connector 10 relative to the cable 1 with the conductive braid held firm against an outer surface of the connector body. Knurling on an exterior of the shell facilitates turning to mate the complementary portions. It will be appreciated that such threaded interconnection is by way of example only. Any suitably fastening mechanism is suitably employed, such as used in connection with quick lock connectors, including examples of HPQN, MiniQuick, QLS, QMA, QN, Mini-QMA, WQMA and SnapN connectors. Other suitable connectors suitably include bayonet connectors, spring connectors, base connectors, push-pull connectors, or the like.

Figure 2:
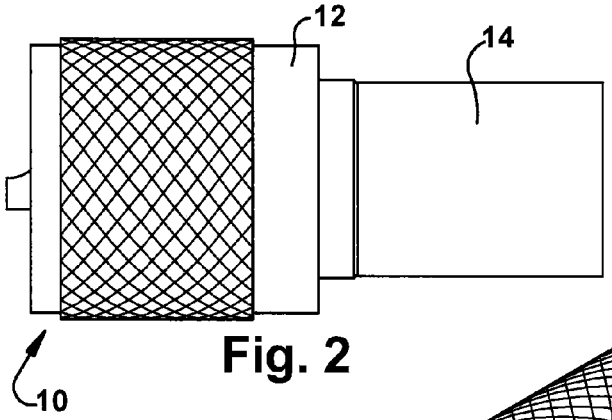
FIG. 2 is a side view of the connector of FIG. 1.
Figure 3:
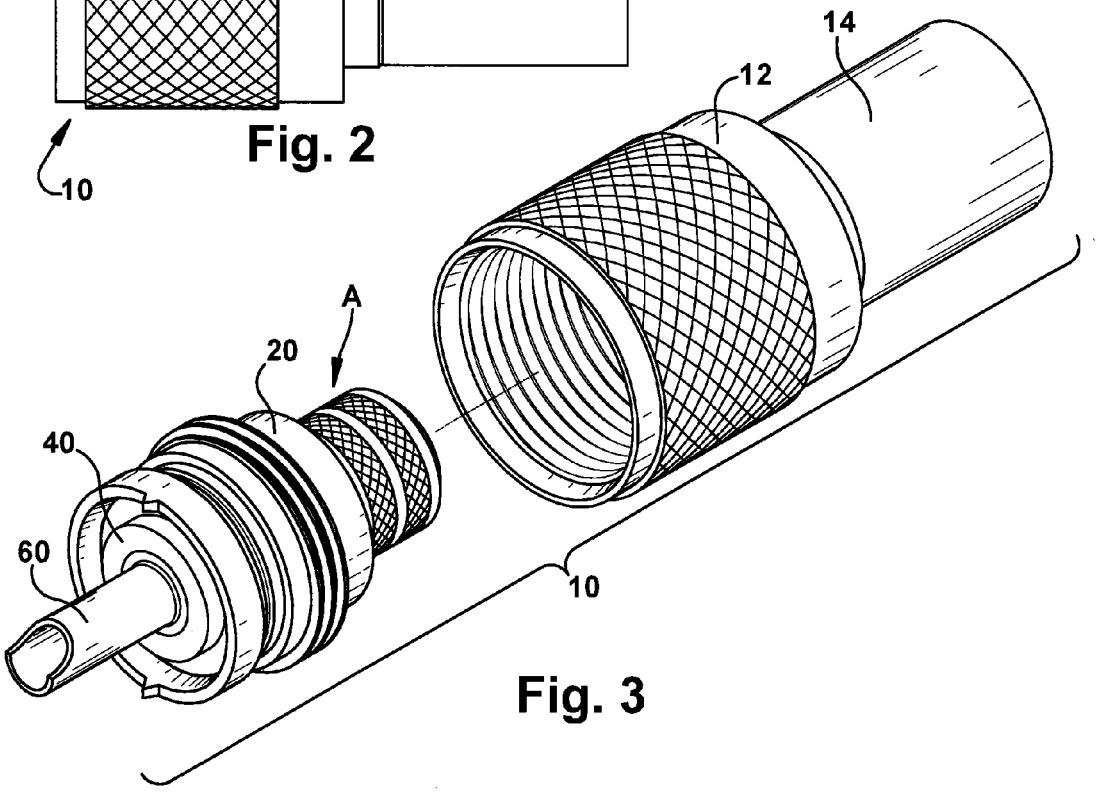
FIG. 3 is a perspective partially exploded view of the connector of FIG. 1 showing a subassembly of the connector separated from the outer shell and ferrule along a longitudinal axis of the connector.
Figure 4:
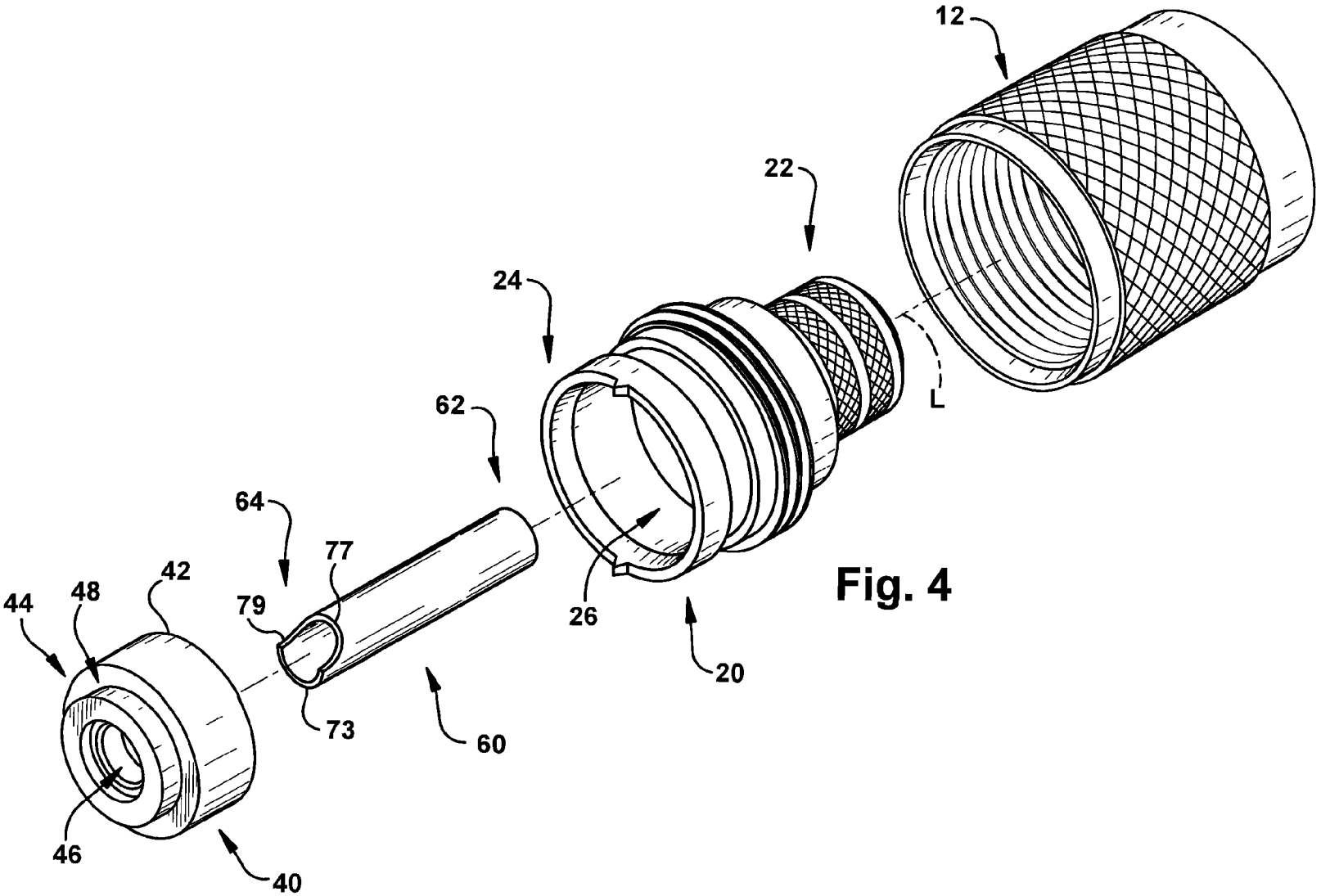
FIG. 4 is a perspective exploded view of the connector of FIG. 1 with the ferrule removed and showing components of the subassembly and the outer shell spaced apart along the longitudinal axis of the connector.
Figure 9:
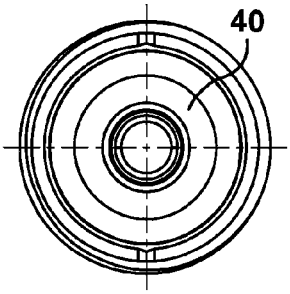
FIG. 9 is a longitudinal front end view of the subassembly of the connector of FIG. 1.
Figure 5:
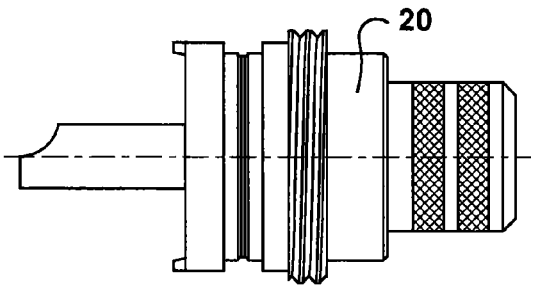
FIG. 5 is a front side view of the subassembly of the connector of FIG. 1.
Figure 10:
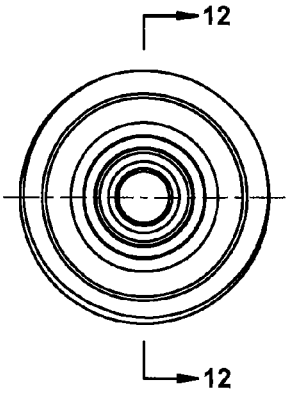
FIG. 10 is a longitudinal rear end view of the subassembly of the connector of FIG. 1.
Figure 6:
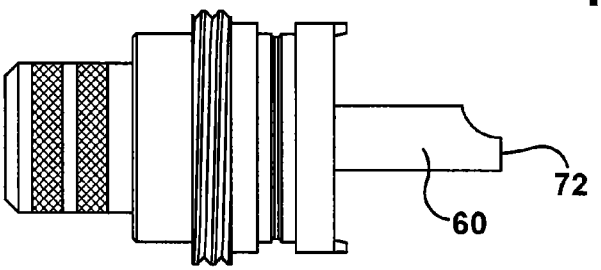
FIG. 6 is a rear side view of the subassembly of the connector of FIG. 1.
Figure 7:
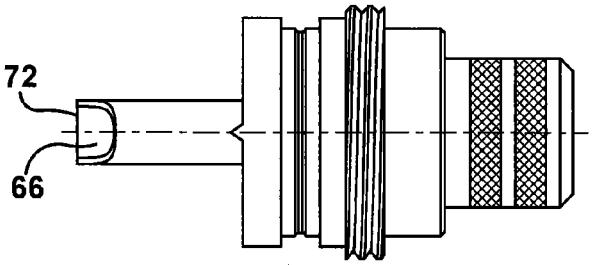
FIG. 7 is a top view of the subassembly of the connector of FIG. 1.
Figure 8:
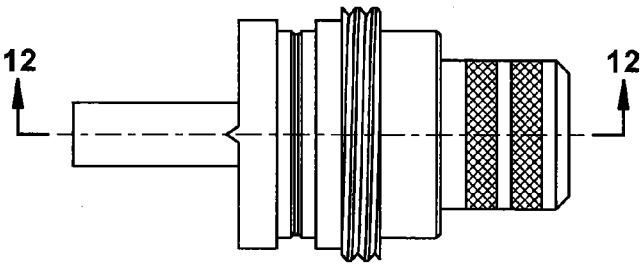
FIG. 8 is a bottom view of the subassembly of the connector of FIG. 1.
Figure 11:
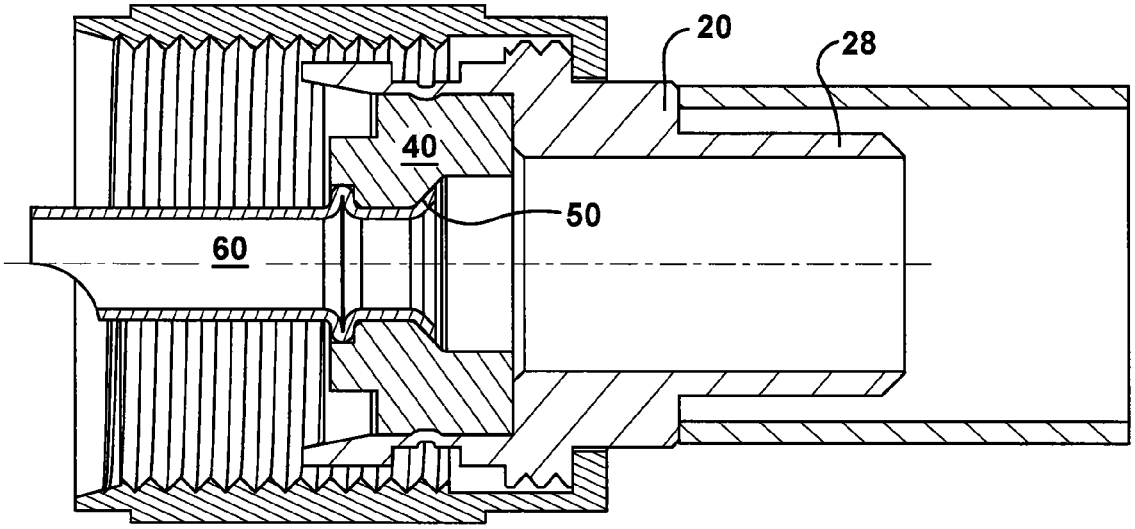
FIG. 11 is an inverted cross-sectional view of the connector of FIG. 1 taken along line 11-11 in FIG. 1.
Figure 12:
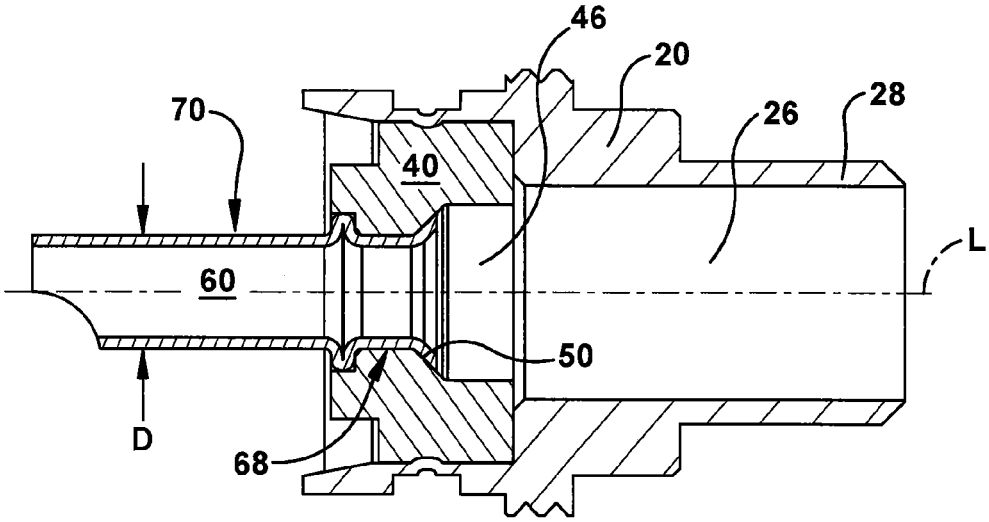
FIG. 12 is a cross-sectional view of the subassembly of the connector of FIG. 1 taken along line 12-12 in FIG. 8.

FIGS. 1 and 2 show the connector 10 with both the outer shell member 12 and the ferrule 14 attached with the body member 20, the spacer disk 40, and with the contact pin member 60. The subassembly A comprising the body member 20, the spacer disk 40, and the contact pin member 60 is illustrated in FIG. 3 removed from the outer shell member 12 and FIG. 4 shows the subassembly A comprising the body member 20, the spacer disk 40, and the contact pin member 60 in an exploded view and in an orientation relative to the outer shell member 12 spaced along the longitudinal axis L. FIGS. 5-10 show the subassembly A comprising the body member 20, the spacer disk 40, and the contact pin member 60 in various orientations including a front view (FIG. 5), a rear view (FIG. 6), a top view (FIG. 7), a bottom view (FIG. 8), a front end view (FIG. 9), and a rear end view (FIG. 10). FIG. 11 is a cross-sectional view of the connector 10 including the subassembly, the outer shell member 12 and the ferrule 14. FIG. 12 is a cross-sectional view of the connector 10 including the subassembly, but with the outer shell member 12 and the ferrule 14 removed for clarity of illustration and simplicity of discussion.

Figure 14:
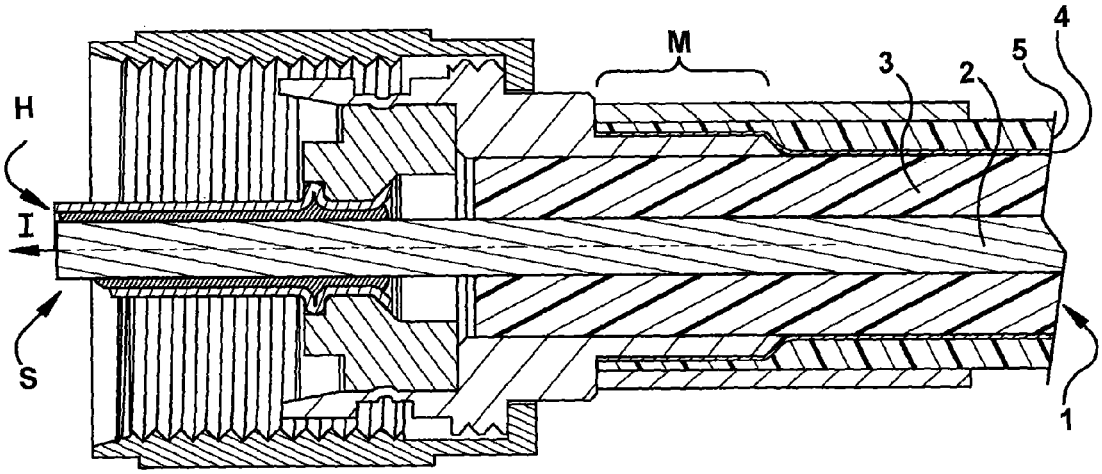
FIG. 14 is an inverted cross-sectional view of the connector of FIG. 1 taken along line 14-14 in FIG. 13 illustrating the use of the connector with the associated coaxial cable wherein a portion of the outer jacket is removed from around the conductive braid shield in an area M adjacent the ferrule.
Figure 14A:
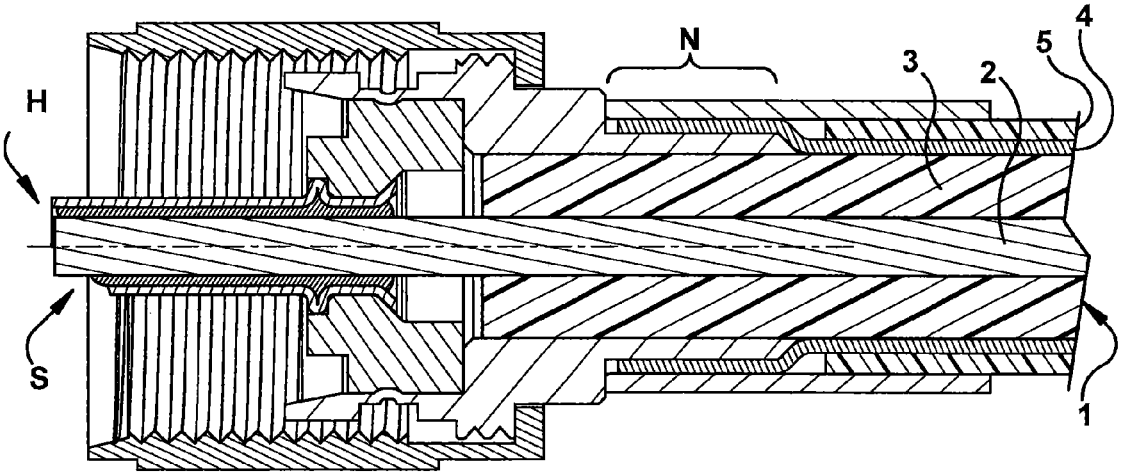

With continued reference to the drawings and with particular reference to FIGS. 1-14 and 29, the hybridized cable connector 10 in accordance with the first example embodiment comprises, as noted, a substantially cylindrical body member 20 having opposite first 22 and second 24 ends. The cylindrical body member 20 defines an elongated central aperture 26 extending through the body member 20 along a central longitudinal axis L between the first 22 and second 24 ends of the body member 20. The first end 22 of the body 20 defines a cylindrical insertion member 28 configured to receive the central conductor 2 of the associated coaxial cable 1 and the insulating material 3 surrounding the central conductor 2 within the cylindrical insertion member 28. In an embodiment the foil (not shown) may be received within the cylindrical insertion member 28 as necessary or desired. Further, the cylindrical insertion member 28 carries the conductive braid 4 of the associated coaxial cable 1 on an outer surface of the cylindrical insertion member 28 as best shown, for example, in FIGS. 14 and 14*a*. In that way, the conductive braid of the associated coaxial cable 1 makes an electromechanical connection with the first end 22 of the body. In the example embodiment illustrated, two (2) rows of spaced apart knurled surfaces are provided on the outer surface of the insertion member 28 as shown in FIGS. 4-8. The rows of spaced apart knurled surfaces help to ensure a good electromechanical connection between the conductive braid 4 of the associated coaxial cable 1 and the an outer surface of the cylindrical insertion member 28. FIG. 14 is an inverted cross-sectional view of the connector of FIG. 1 taken along line 14-14 in FIG. 13 illustrating the use of the connector with the associated coaxial cable wherein a portion of the outer jacket is removed from around the conductive braid shield in an area M adjacent the ferrule. FIG. 14*a* is an inverted cross-sectional view of the connector of FIG. 1 taken along line 14-14 in FIG. 13 illustrating the use of the connector with the associated coaxial cable wherein all of the outer jacket is removed from around the conductive braid shield in the area N adjacent the ferrule.

Further in accordance with the first example embodiment, the spacer disk 40 of the hybridized cable connector 10 is received in the second end 24 of the body member 20. As shown, the spacer disk 40 has opposite first 42 and second 44 ends and defines a centering aperture 46 extending through the spacer disk 40 along the central longitudinal axis L between the first 42 and second 44 ends of the spacer disk 40. Preferably, the spacer disk 40 is made of an electrically insulating material such as PTFE, for example.

Yet still further, the contact pin member 60 is received in the centering aperture 46 of the spacer disk 40 and has opposite first 62 and second 64 ends. The contact pin member 60 is generally hollow and defines an alignment aperture 66 extending through the contact pin member 60 along the central longitudinal axis L between the first 62 and second 64 ends of the contact pin member 60. In general, the alignment aperture 66 is configured to closely receive the central conductor 2 of the associated coaxial cable 1 therein such as shown for example in FIGS. 14 and 14*a*. The first end 62 of the contact pin member 60 defines a connection portion 68 disposed within the centering aperture 46 of the spacer disk 40. Importantly and in accordance with the example embodiments herein, the second end 64 of the contact pin member 60 defines an interface portion 70 having a substantially constant outer diameter D extending outwardly from the spacer disk 40 along the central longitudinal axis L beyond an extent of the body member 20 in an insertion direction I directed from the first end 22 of the body member 20 to the second end 24 of the body member 20. Preferably, the interface portion 70 extends outwardly from the spacer disk 40 along the central longitudinal axis L beyond the extent of the body member 20 in the insertion direction I and has a single substantially constant outer diameter D. Further preferably, the interface portion 70 defines an edge 72 on the second end 64 of the contact pin member 60, and all of the interface portion 70 between the extent of the body member 20 in the insertion direction I and the edge 72 on the second end 64 has the outer diameter D.

As noted above, the interface portion 70 of the connector 10 defines an edge 72 on the second end 62 of the contact pin member 60. The edge 72 comprises a semicircular edge portion 73 disposed in a plane substantially perpendicular to the central longitudinal axis L, a curvilinear edge portion 75 comprising one or more regions 77 disposed in a plane substantially perpendicular to the central longitudinal axis L, and one or more regions 79 disposed in a plane substantially parallel with the central longitudinal axis L.

It is to be noted that the presence of the curvilinear edge portion 75 causes a disruption to an otherwise complete circular portion forming the semicircular edge portion 73 relative to the edge 72 of the contact pin member 60 making it unsuitable in a practical sense from being crimped relative to the central conductor 2 of the coaxial cable. The curvilinear edge portion 75 of the example embodiments herein would induce the interface portion 70 of the pin member 60 to "roll" or otherwise distort during a crimping operation resulting in a poor or lack of electro-mechanical connection between the central conductor of the coaxial cable and the contact pin member. Accordingly, the interface portion 70 of the pin member 60 having the curvilinear edge portion 75 is suitable for practical use exclusively in solder type connections with the central conductor 2 and unsuitable for use with crimp type connections between the pin member 60 and the conductor 2. Further the interface portion 70 of the pin member 60 having the curvilinear edge portion 75 is also unsuitable for use with connections being of the dual "crimp or solder" type connections between the pin member 60 and the conductor 2, wherein these connections, even though intended to be used with solder must also be workable in the crimp style connection as well.

On the other hand, it is to further be noted that the curvilinear edge portion 75 advantageously enables direct access to the end of the central conductor 2 in an area S (FIGS. 14, 14*a*) for application of heat and/or solder directly to the central conductor of the coaxial cable. Solder may also be applied in the area H (FIGS. 14, 14*a*) as necessary or desired for flowing solder into the gap between the pin member 60 and the central conductor 2. The curvilinear edge portion 75 also helps to enable visual inspection of the solder joint to ensure that the solder has flowed into the gap between the central conductor and the aperture 66 of the contact pin member 60.

With regard to the connection portion 68 of the contact pin member 60, a radially outwardly directed tapered portion 74 is defined. The tapered portion 74 is configured to guide a free end of the central conductor 2 relative to the first end 62 of the contact pin member 60 and into the alignment aperture 66 as the associated coaxial cable 1 is inserted into the connector 10 in the insertion direction I. As shown best in FIG. 29, the radially outwardly directed tapered portion 74 of the connection portion 68 of the contact pin member 60 defines an angle A relative to the central longitudinal axis L of about 45°.

As shown best in the cross-sectional views of FIGS. 11, 12, and 14, the spacer disk 40 defines a circular groove 48 on the second end 44 thereof. In that way, an outwardly directed circular ridge member 76 of the connection portion 68 of the contact pin member 60 is selectively received in the circular groove 48 of the spacer disk 40. In addition, the spacer disk 40 defines both a tapered surface 50 opening radially outwardly in a direction opposite the insertion direction I, as well as the circular groove 48 on the second end 44 thereof. Correspondingly, the connection portion 68 of the contact pin member 60 defines an outwardly directed circular or otherwise rounded or curved ridge member 76 received in the circular groove 48 of the spacer disk 40, and a radially outwardly directed tapered portion 74 received on the tapered surface 50 of the spacer disk. The radially outwardly directed tapered portion 74 is configured to guide a free end of the central conductor 2 relative to the first end 62 of the contact pin member 60 and into the alignment aperture 66 as the associated coaxial cable 1 is inserted into the connector 10 in the insertion direction I.

With continued reference to the drawing Figures and with particular reference next to FIGS. 15-29, a hybridized cable connector 10' in accordance with a second example embodiment is shown wherein like elements relative to the hybridized cable connector 10 in accordance with the first example embodiment will be referenced with primed (') numerals. As best shown in the cross-sectional view of FIGS. 28 and 28*a*, the connector is configured for use with an associated coaxial cable 1 having a central conductor 2, an insulating material 3 surrounding the central conductor 2, a conductive braid 4 surrounding the insulating material 3, and an outer jacket 5 surrounding the conductive braid 4. However, the connectors of the example embodiments are also configured for use with associated coaxial cables 1' such as the example shown in FIG. 43 having a central conductor 2', an insulating material 3' surrounding the central conductor 2', a foil layer 6 surrounding the insulating material 3', a conductive braid 4' surrounding the foil layer 6, and an outer jacket 5' surrounding the conductive braid 4'.

In any case, the connector 10' comprises, in general, a substantially cylindrical body member 20', a spacer disk 40', and a contact pin member 60', forming a subassembly A' of the connector 10. In the illustrate example, the connector 10' further comprises an outer shell member 12' and a ferrule 14'. Overall, the outer shell member 12' is configured to assist in attaching and holding the connector 10 to an associated female socket connector (not shown) such as, for example, to an associated SO-239 connector. The ferrule 14' is configured to be crimped onto the associated coaxial cable 1 for attaching and holding the connector 10' relative to the cable 1 with the conductive braid 4 held against an outer surface of the connector body. Knurling on an exterior of the shell facilitates turning to mate the complementary portions. It will be appreciated that such threaded interconnection is by way of example only. Any suitably fastening mechanism is suitably employed, such as used in connection with quick lock connectors, including examples of HPQN, MiniQuick, QLS, QMA, QN, Mini-QMA, WQMA and SnapN connectors. Other suitable connectors suitably include bayonet connectors, spring connectors, base connectors, push-pull connectors, or the like.

FIGS. 15 and 16 show the connector 10' with both the outer shell member 12' and the ferrule 14' attached with the body member 20', the spacer disk 40', and with the contact pin member 60'. The subassembly A' comprising the body member 20', the spacer disk 40', and the contact pin member 60' is illustrated in FIG. 17 removed from the outer shell member 12' and FIG. 18 shows the subassembly A' comprising the body member 20', the spacer disk 40', and the contact pin member 60' in an exploded view and in an orientation relative to the outer shell member 12'. FIGS. 19-24 show the subassembly A' comprising the body member 20', the spacer disk 40', and the contact pin member 60' in various orientations. FIG. 25 is a cross-sectional view of the connector 10' including the subassembly, the outer shell member 12' and the ferrule 14'. FIG. 26 is a cross-sectional view of the connector 10' including the subassembly, but with the outer shell member 12' and the ferrule 14' removed for clarity of illustration and simplicity of discussion.

With continued reference to the drawings and with particular reference to FIGS. 15-29, the hybridized cable connector 10' in accordance with the second example embodiment comprises, as noted, a substantially cylindrical body member 20' having opposite first 22' and second 24' ends. The cylindrical body member 20' defines an elongated central aperture 26' extending through the body member 20' along a central longitudinal axis L between the first 22' and second 24' ends of the body member 20'. The first end 22' of the body 20' defines a cylindrical insertion member 28' configured to receive the central conductor 2 of the associated coaxial cable 1 and, optionally, the foil (not shown) of the coaxial cable as necessary or desired within the cylindrical insertion member 28'. Further, the cylindrical insertion member 28' carries the conductive braid 4 of the associated coaxial cable 1 on an outer surface of the cylindrical insertion member 28' as best shown, for example, in FIGS. 28 and 28*a*. In that way, the conductive braid of the associated coaxial cable 1 makes an electromechanical connection with the first end 22' of the body. In the example embodiment illustrated, two (2) rows of spaced apart knurled surfaces are provided on the outer surface of the insertion member 28' as shown in FIGS. 17-24. The rows of spaced apart knurled surfaces help to ensure a good electro-mechanical connection between the conductive braid 4 of the associated coaxial cable 1 and the an outer surface of the cylindrical insertion member 28'. FIG. 28 is an inverted cross-sectional view of the connector of FIG. 15 taken along line 28-28 in FIG. 27 illustrating the use of the connector with the associated coaxial cable wherein a portion of the outer jacket is removed from around the conductive braid shield in an area M adjacent the ferrule. FIG. 28*a* is an inverted cross-sectional view of the connector of FIG. 15 taken along line 28-28 in FIG. 27 illustrating the use of the connector with the associated coaxial cable wherein all of the outer jacket is removed from around the conductive braid shield in the area N adjacent the ferrule.

Further in accordance with the second example embodiment, the spacer disk 40' of the hybridized cable connector 10' is received in the second end 24' of the body member 20'. As shown, the spacer disk 40' has opposite first 42' and second 44' ends and defines a centering aperture 46' extending through the spacer disk 40' along the central longitudinal axis L between the first 42' and second 44' ends of the spacer disk 40'. Preferably, the spacer disk 40' is made of an electrically insulating material such as PTFE, for example.

Yet still further, the contact pin member 60' is received in the centering aperture 46' of the spacer disk 40' and has opposite first 62' and second 64' ends. The contact pin member 60' defines an alignment aperture 66' extending through the contact pin member 60' along the central longitudinal axis L between the first 62' and second 64' ends of the contact pin member 60'. In general, the alignment aperture 66' is configured to receive the central conductor 2 of the associated coaxial cable 1 therein such as shown for example in FIGS. 28 and 28*a*. The first end 62' of the contact pin member 60' defines a connection portion 68' disposed within the centering aperture 46' of the spacer disk 40'. Importantly and in accordance with the example embodiments herein, the second end 64' of the contact pin member 60' defines an interface portion 70' having a substantially constant outer diameter D extending outwardly from the spacer disk 40' along the central longitudinal axis L beyond an extent of the body member 20' in an insertion direction I directed from the first end 22' of the body member 20' to the second end 24' of the body member 20'. Preferably, the interface portion 70' extends outwardly from the spacer disk 40' along the central longitudinal axis L beyond the extent of the body member 20' in the insertion direction I and has a single substantially constant outer diameter D. Further preferably, the interface portion 70' defines an edge 72' on the second end 64 of the contact pin member 60, and all of the interface portion 70' between the extent of the body member 20 in the insertion direction I and the edge 72' on the second end 64' has the outer diameter D.

As noted above, the interface portion 70' of the connector 10' defines an edge 72' on the second end 62' of the contact pin member 60'. The edge 72' comprises a semicircular edge portion 73' disposed in a plane substantially perpendicular to the central longitudinal axis L, a curvilinear edge portion 75' comprising one or more regions 77' disposed in a plane substantially perpendicular to the central longitudinal axis L, and one or more regions 79' disposed in a plane substantially parallel with the central longitudinal axis L.

It is to be noted that the presence of the curvilinear edge portion 75' causes a disruption to an otherwise complete circular portion forming the semicircular edge portion 73' relative to the edge 72' of the contact pin member 60' making it unsuitable in a practical sense from being crimped relative to the central conductor 2 of the coaxial cable. The curvilinear edge portion 75' of the example embodiments herein would induce the interface portion 70' of the pin member 60' to "roll" or otherwise distort during a crimping operation resulting in a poor or lack of electro-mechanical connection between the central conductor of the coaxial cable and the contact pin member. Accordingly, the interface portion 70' of the pin member 60' having the curvilinear edge portion 75' is suitable for practical use exclusively in solder type connections with the central conductor 2 and unsuitable for use with crimp type connections between the pin member 60' and the conductor 2. Further the interface portion 70' of the pin member 60' having the curvilinear edge portion 75' is also unsuitable for use with connections being of the dual "crimp or solder" type connections between the pin member 60' and the conductor 2, wherein these connections, even though intended to be used with solder must also be workable in the crimp style connection as well.

On the other hand, it is to further be noted that the curvilinear edge portion 75' advantageously enables direct access to the end of the central conductor 2 in an area S (FIGS. 28, 28*a*) for application of heat and/or solder directly to the central conductor of the coaxial cable. Solder may also be applied in the area H (FIGS. 28, 28*a*) as necessary or desired for flowing solder into the gap between the pin member 60' and the central conductor 2. The curvilinear edge portion 75' also helps to enable visual inspection of the solder joint to ensure that the solder has flowed into the gap between the central conductor and the aperture 66' of the contact pin member 60'.

With regard to the connection portion 68' of the contact pin member 60', a radially outwardly directed tapered portion 74' is defined. The tapered portion 74' is configured to guide a free end of the central conductor 2 relative to the first end 62' of the contact pin member 60' and into the alignment aperture 66' as the associated coaxial cable 1 is inserted into the connector 10' in the insertion direction I. As shown best in FIG. 29, the radially outwardly directed tapered portion 74' of the connection portion 68' of the contact pin member 60' defines an angle A relative to the central longitudinal axis L of about 45°.

As shown best in the cross-sectional views of FIGS. 25, 26, and 28, the spacer disk 40' defines a circular groove 48' on the second end 44' thereof. In that way, an outwardly directed circular ridge member 76' of the connection portion 68' of the contact pin member 60' is selectively received in the circular groove 48' of the spacer disk 40'. In addition, the spacer disk 40 defines both a tapered surface 50' opening radially outwardly in a direction opposite the insertion direction I, as well as the circular groove 48' on the second end 44' thereof. Correspondingly, the connection portion 68' of the contact pin member 60' defines an outwardly directed circular or otherwise rounded or curved ridge member 76' received in the circular groove 48' of the spacer disk 40', and a radially outwardly directed tapered portion 74' received on the tapered surface 50' of the spacer disk. The radially outwardly directed tapered portion 74' is configured to guide a free end of the central conductor 2 relative to the first end 62' of the contact pin member 60' and into the alignment aperture 66' as the associated coaxial cable 1 is inserted into the connector 10 in the insertion direction I.

With continued reference to the drawing Figures and with particular reference next to FIGS. 30-43, a hybridized cable connector 10" in accordance with a third example embodiment is shown wherein like elements relative to the hybridized cable connector 10, 10' in accordance with the first and second example embodiments will be referenced with double primed (") numerals. As best shown in the cross-sectional view of FIG. 30, the connector is configured for use with an associated coaxial cable 1' such as the example shown in FIG.

43 having a central conductor 2', an insulating material 3' surrounding the central conductor 2', a foil layer 6 surrounding the insulating material 3', a conductive braid 4' surrounding the foil layer 6, and an outer jacket 5' surrounding the conductive braid 4'. However, the connectors of the example embodiments are also configured for use with associated coaxial cables 1 such as shown in FIG. 14 for example having a central conductor 2, an insulating material 3 surrounding the central conductor 2, a conductive braid 4 surrounding the insulating material 3, and an outer jacket 5 surrounding the conductive braid 4.

In any case, the connector 10" comprises, in general, a substantially cylindrical body member 20", a spacer disk 40", and a contact pin member 60", forming a subassembly A" of the connector 10. In the illustrate example, the connector 10" further comprises an outer shell member 12" and a ferrule 14". Overall, the outer shell member 12" is configured to assist in attaching and holding the connector 10" to an associated female socket connector (not shown) such as, for example, to an associated SO-239 connector. The ferrule 14" is configured to be crimped onto the associated coaxial cable 1 for attaching and holding the connector 10" relative to the cable 1' with the conductive braid 4' held against an outer surface of the connector body. Knurling on an exterior of the shell facilitates turning to mate the complementary portions. It will be appreciated that such threaded interconnection is by way of example only. Any suitably fastening mechanism is suitably employed, such as used in connection with quick lock connectors, including examples of HPQN, MiniQuick, QLS, QMA, QN, Mini-QMA, WQMA and SnapN connectors. Other suitable connectors suitably include bayonet connectors, spring connectors, base connectors, push-pull connectors, or the like.

FIGS. 30 and 31 show the connector 10" with both the outer shell member 12" and the ferrule 14" attached with the body member 20", the spacer disk 40", and with the contact pin member 60". The subassembly A" comprising the body member 20", the spacer disk 40", and the contact pin member 60" is illustrated in FIG. 32 removed from the outer shell member 12" and FIG. 33 shows the subassembly A" comprising the body member 20", the spacer disk 40", and the contact pin member 60" in an exploded view and in an orientation relative to the outer shell member 12". FIGS. 34-39 show the subassembly A" comprising the body member 20", the spacer disk 40", and the contact pin member 60" in various orientations. FIG. 40 is a cross-sectional view of the connector 10" including the subassembly, the outer shell member 12" and the ferrule 14". FIG. 41 is a cross-sectional view of the connector 10" including the subassembly, but with the outer shell member 12" and the ferrule 14" removed for clarity of illustration and simplicity of discussion.

With continued reference to the drawings and with particular reference to FIGS. 30-33 and 44, the hybridized cable connector 10" in accordance with the first example embodiment comprises, as noted, a substantially cylindrical body member 20" having opposite first 22" and second 24" ends. The cylindrical body member 20" defines an elongated central aperture 26" extending through the body member 20" along a central longitudinal axis L between the first 22" and second 24" ends of the body member 20". The first end 22" of the body 20" defines a cylindrical insertion member 28" configured to receive the central conductor 2' of the associated coaxial cable 1' and the insulating material 3' surrounding the central conductor 2' within the cylindrical insertion member 28". Further, the cylindrical insertion member 28" carries the conductive braid 4' of the associated coaxial cable 1' on an outer surface of the cylindrical insertion member 28' as best shown, for example, in FIG. 33.

Further in accordance with the third example embodiment, the spacer disk 40" of the hybridized cable connector 10" is received in the second end 24" of the body member 20". As shown, the spacer disk 40" has opposite first 42" and second 44" ends and defines a centering aperture 46" extending through the spacer disk 40" along the central longitudinal axis L between the first 42" and second 44" ends of the spacer disk 40". Preferably, the spacer disk 40" is made of an electrically insulating material such as PTFE, for example.

Yet still further, the contact pin member 60" is received in the centering aperture 46" of the spacer disk 40" and has opposite first 62" and second 64" ends. The contact pin member 60" defines an alignment aperture 66" extending through the contact pin member 60" along the central longitudinal axis L between the first 62" and second 64" ends of the contact pin member 60". In general, the alignment aperture 66" is configured to receive the central conductor 2' of the associated coaxial cable 1' therein such as shown for example in FIG. 33. The first end 62" of the contact pin member 60" defines a connection portion 68" disposed within the centering aperture 46" of the spacer disk 40". Importantly and in accordance with the example embodiments herein, the second end 64" of the contact pin member 60" defines an interface portion 70" having a substantially constant outer diameter D extending outwardly from the spacer disk 40" along the central longitudinal axis L beyond an extent of the body member 20" in an insertion direction I directed from the first end 22" of the body member 20" to the second end 24" of the body member 20". Preferably, the interface portion 70" extends outwardly from the spacer disk 40" along the central longitudinal axis L beyond the extent of the body member 20" in the insertion direction I and has a single substantially constant outer diameter D. Further preferably, the interface portion 70" defines an edge 72" on the second end 64" of the contact pin member 60", and all of the interface portion 70" between the extent of the body member 20" in the insertion direction I and the edge 72" on the second end 64" has the outer diameter D.

As noted above, the interface portion 70" of the connector 10" defines an edge 72" on the second end 62" of the contact pin member 60". The edge 72" comprises a semicircular edge portion 73" disposed in a plane substantially perpendicular to the central longitudinal axis L, a linear edge portion 75" comprising one or more regions 77" disposed in a plane substantially perpendicular to the central longitudinal axis L, and one or more regions 79" disposed in a plane substantially parallel with the central longitudinal axis L. In addition, as shown in FIG. 44, the end of the interface portion 70" may include a beveled area wherein the wall of the end is reduced to be narrower at the edge 72" than at the major portion of the interface portion 70".

It is to be noted that the presence of the linear edge portion 75" causes a disruption to an otherwise complete circular portion forming the semicircular edge portion 73" relative to the edge 72" of the contact pin member 60" making it unsuitable in a practical sense from being crimped relative to the central conductor 2' of the coaxial cable. The linear edge portion 75" of the example embodiments herein would induce the interface portion 70" of the pin member 60" to "roll" or otherwise distort during a crimping operation resulting in a poor or lack of electro-mechanical connection between the central conductor of the coaxial cable and the contact pin member. Accordingly, the interface portion 70" of the pin member 60" having the linear edge portion 75" is suitable for practical use exclusively in solder type connections with the central conductor 2' and unsuitable for use with crimp type connections between the pin member 60" and the conductor 2'. Further the interface portion 70" of the pin member 60" having the linear edge portion 75" is also unsuitable for use with connections being of the dual "crimp or solder" type connections between the pin member 60" and the conductor 2', wherein these connections, even though intended to be used with solder must also be workable in the crimp style connection as well.

On the other hand, it is to further be noted that the linear edge portion 75" advantageously enables direct access to the end of the central conductor 2' in an area S (FIG. 43) for application of heat and/or solder directly to the central conductor of the coaxial cable. Solder may also be applied in the area H (FIG. 43) as necessary or desired for flowing solder into the gap between the pin member 60" and the central conductor 2'. The linear edge portion 75" also helps to enable visual inspection of the solder joint to ensure that the solder has flowed into the gap between the central conductor and the aperture 66 of the contact pin member 60".

With regard to the connection portion 68" of the contact pin member 60", a radially outwardly directed tapered portion 74" is defined. The tapered portion 74" is configured to guide a free end of the central conductor 2' relative to the first end 62" of the contact pin member 60" and into the alignment aperture 66" as the associated coaxial cable 1 is inserted into the connector 10" in the insertion direction I. As shown best in FIG. 44, the radially outwardly directed tapered portion 74" of the connection portion 68" of the contact pin member 60" defines an angle A relative to the central longitudinal axis L of about 15°.

As shown best in the cross-sectional views of FIGS. 40, 41, and 43, the spacer disk 40" defines a circular groove 48" on the second end 44" thereof. In that way, an outwardly directed ridge member 76" of the connection portion 68" of the contact pin member 60" is selectively received in the circular groove 48" of the spacer disk 40". The ridge member 76" has a rectangular cross-sectional shape in the embodiment. In addition, the spacer disk 40" defines both a tapered surface 50" opening radially outwardly in a direction opposite the insertion direction I, as well as the circular groove 48" on the second end 44" thereof. Correspondingly, the connection portion 68" of the contact pin member 60" defines an outwardly directed circular ridge member 76" received in the circular groove 48" of the spacer disk 40", and a radially outwardly directed tapered portion 74" received on the tapered surface 50" of the spacer disk. The radially outwardly directed tapered portion 74" is configured to guide a free end of the central conductor 2' relative to the first end 62" of the contact pin member 60" and into the alignment aperture 66" as the associated coaxial cable 1 is inserted into the connector 10" in the insertion direction I.

It is to be appreciated that in the embodiments described above, FIGS. 1-14, FIGS. 15-28, and FIGS. 30-43 illustrate first, second, and third embodiments of a connector having different properties; namely different size properties, so as to associate with differently sized associated coaxial cables. In addition, FIGS. 29 and 44 illustrate alternative contact pin constructions in connection with the disclosed embodiments.

It is to be appreciated that, in the example embodiment illustrated at FIG. 44 wherein tip portion includes a flared end, suitably at about 15 degrees, the flared end may be selected at any angle greater than zero degrees and less than 90 degrees as may be dictated by a particular application. The flared portion is disposed opposite a notched end, wherein the flared end is in contact with a complementary associated interior surface of the dielectric, connector body or shell. As noted with the embodiments above, it will be appreciated from the description herein that a central coaxial conductor 2 suitably inserted into the tip portion 60, 60', 60" is operably soldered so as to form a good mechanical or electrical connection between the two.

Described above are example embodiments. It is, of course, not possible to describe every conceivable combination of components or methodologies, but one of ordinary skill in the art will recognize that many further combinations and permutations of the example embodiments are possible. Accordingly, this application is intended to embrace all such alterations, modifications and variations that fall within the spirit and scope of the appended claims interpreted in accordance with the breadth to which they are fairly, legally and equitably entitled.

It is claimed:

1. A connector (10) for use with an associated coaxial cable (1) having a central conductor (2), an insulating material (3) surrounding the central conductor (2), a conductive braid (4) surrounding the insulating material (3), and an outer jacket (5) surrounding the conductive braid (4), the connector (10) comprising:

a substantially cylindrical body member (20) having opposite first (22) and second (24) ends and defining an elongate central aperture (26) extending through the body member (20) along a central longitudinal axis L between the first (22) and second (24) ends of the body member (20), the first end (22) of the body (20) defining a cylindrical insertion member (28) configured to receive the central conductor (2) of the associated coaxial cable (1) and the insulating material (3) within the cylindrical insertion member (28), and the cylindrical insertion member (28) being configured to couple directly on an outer surface thereof with the conductive braid (4) of the associated coaxial cable (1);

a spacer disk (40) received in the second end (24) of the body member (20), the spacer disk (40) having opposite first (42) and second (44) ends and defining a centering aperture (46) extending through the spacer disk (40) along the central longitudinal axis L between the first (42) and second (44) ends of the spacer disk (40);

a contact pin member (60) received in the centering aperture (46) of the spacer disk (40), the contact pin member (60) having opposite first (62) and second (64) ends and defining an alignment aperture (66) extending through the contact pin member (60) along the central longitudinal axis L between the first (62) and second (64) ends of the contact pin member (60), the alignment aperture (66) being configured to receive and couple with the central conductor (2) of the associated coaxial cable (1) therein, the first end (62) of the contact pin member (60) defining a connection portion (68) disposed within the centering aperture (46) of the spacer disk (40) and the second end (64) of the contact pin member (60) defining an interface portion (70) having a substantially constant outer diameter D extending outwardly from the spacer disk (40) along the central longitudinal axis L beyond an extent of the body member (20) in an insertion direction I directed from the first end (22) of the body member (20) to the second end (24) of the body member (20); wherein the interface portion (70") defines an edge (72") on the second end (64") of the contact pin member (60"), the edge (72") comprising:

a semicircular edge portion (73") disposed in a plane substantially perpendicular to the central longitudinal axis L; and a linear edge portion (75") comprising one or more regions (77) disposed in a plane substantially oblique to the central longitudinal axis L, one or more regions (79") disposed in a plane substantially parallel with the central longitudinal axis L, and one or more regions (77") disposed in a plane substantially perpendicular to the central longitudinal axis L.

2. The connector (10) according to claim 1 wherein:

the contact pin member (60) is configured to receive and selectively flow an associated solder material in a space between the alignment aperture (66) and the associated central conductor (2).

3. The conductor (10) according to claim 2, further comprising:

a ferrule (14) surrounding the cylindrical insertion member (28) of the body member (20), the ferrule (14) being selectively crimpable onto the cylindrical insertion member (28) to hold the conductive braid (4) of the associated coaxial cable (1) in close direct contact with the outer surface of the insertion member (28).

4. The connector (10) according to claim 3 wherein the interface portion (70) extending outwardly from the spacer disk (40) along the central longitudinal axis L beyond the extent of the body member (20) in the insertion direction I has a single substantially constant outer diameter D.

5. The connector (10) according to claim 4 wherein:

all of the interface portion (70) between the extent of the body member (20) in the insertion direction I and the edge (72) on the second end (64) has the outer diameter D.

6. The connector (10) according to claim 1 wherein:

the connection portion (68) of the contact pin member (60) defines a radially outwardly directed tapered portion (74) configured to guide a free end of the central conductor (2) relative to the first end (62) of the contact pin member (60) and into the alignment aperture (66) as the associated coaxial cable (1) is inserted into the connector (10) in the insertion direction I.

7. The connector (10) according to claim 6 wherein the radially outwardly directed tapered portion (74) of the connection portion (68) of the contact pin member (60) defines an angle A relative to the central longitudinal axis L of about 45°.

8. The connector (10) according to claim 1 wherein:

the spacer disk (40) defines a circular groove (48) on the second end (44) thereof; and the connection portion (68) of the contact pin member (60) defines an outwardly directed circular ridge member (76) received in the circular groove (48) of the spacer disk (40).

9. The connector (10) according to claim 1 wherein:

the spacer disk (40) defines i) a tapered surface (50) opening radially outwardly in a direction opposite the insertion direction I, and ii) a circular groove (48) on the second end (44) thereof; and the connection portion (68) of the contact pin member (60) defines: i) an outwardly directed circular ridge member (76) received in the circular groove (48) of the spacer disk (40), and ii) a radially outwardly directed tapered portion (74) received on the tapered surface (50) of the spacer disk (40), the radially outwardly directed tapered portion (74) being configured to guide a free end of the central conductor (2) relative to the first end (62) of the contact pin member (60) and into the alignment aperture (66) as the associated coaxial cable (1) is inserted into the connector (10) in the insertion direction I.

10. A hybrid connector (10) apparatus for solder connection with a central conductor (2) of an associated coaxial cable (1) and crimp connection with a conductive braid (4) surrounding insulating material (3) of the associated coaxial cable (1), the hybrid connector (10) comprising:

a substantially cylindrical body member (20) having opposite first (22) and second (24) ends and defining an elongate central aperture (26) extending through the body member (20) along a central longitudinal axis L between the first (22) and second (24) ends of the body member (20), the first end (22) of the body (20) defining a cylindrical insertion member (28) configured to receive the central conductor (2) of the associated coaxial cable (1) and the insulating material (3) within the cylindrical insertion member (28), and the cylindrical insertion member (28) being configured to couple directly on an outer surface thereof with the conductive braid (4) of the associated coaxial cable (1);

a spacer disk (40) received in the second end (24) of the body member (20), the spacer disk (40) having opposite first (42) and second (44) ends and defining a centering aperture (46) extending through the spacer disk (40) along the central longitudinal axis L between the first (42) and second (44) ends of the spacer disk (40);

a contact pin member (60) received in the centering aperture (46) of the spacer disk (40), the contact pin member (60) having opposite first (62) and second (64) ends and defining an alignment aperture (66) extending through the contact pin member (60) along the central longitudinal axis L between the first (62) and second (64) ends of the contact pin member (60), the alignment aperture (66) being configured to receive and couple with the central conductor (2) of the associated coaxial cable (1) therein, the first end (62) of the contact pin member (60) defining a connection portion (68) disposed within the centering aperture (46) of the spacer disk (40) and the second end (64) of the contact pin member (60) defining an elongate interface portion (70) configured to intermatingly couple with a corresponding receiver portion of an associated socket connector, the connection portion (68) of the contact pin member (60) defining a radially outwardly directed tapered portion (74) configured to guide a free end of the central conductor (2) relative to the first end (62) of the contact pin member (60) and into the alignment aperture (66) as the associated coaxial cable (1) is inserted into the connector (10) in the insertion direction I; wherein the interface portion (70") defines an edge (72") on the second end (64") of the contact pin member (60"), the edge (72") comprising:

a semicircular edge portion (73") disposed in a plane substantially perpendicular to the central longitudinal axis L; and a linear edge portion (75") comprising one or more regions (77) disposed in a plane substantially oblique to the central longitudinal axis L, one or more regions (79") disposed in a plane substantially parallel with the central longitudinal axis L, and one or more regions (77") disposed in a plane substantially perpendicular to the central longitudinal axis L.

11. The hybrid connector (10) according to claim 10 wherein the radially outwardly directed tapered portion (74) of the connection portion (68) of the contact pin member (60) defines an angle A relative to the central longitudinal axis L of about 45°.

* * * * *